US005679055A

United States Patent [19]

Greene et al.

[11] Patent Number: 5,679,055

[45] Date of Patent: Oct. 21, 1997

[54] AUTOMATED WAFER LAPPING SYSTEM

[75] Inventors: George W. Greene, Burlington, Mass.; Peter D. Albrecht, Spartanburg, S.C.; Kenneth D. Strittmatter, Mauldin, S.C.; Rafael Hidalgo, Greenville, S.C.

[73] Assignee: MEMC Electronic Materials, Inc., St. Peters, Mo.

[21] Appl. No.: 653,666

[22] Filed: May 31, 1996

[51] Int. Cl.[6] ..... B24B 37/02

[52] U.S. Cl. ..... 451/10; 451/41; 451/285; 451/286; 451/287; 451/288; 451/289

[58] Field of Search ..... 451/6, 8, 290, 451/254, 256, 550, 334, 339, 268, 269, 42, 285–289, 41

[56] References Cited

U.S. PATENT DOCUMENTS 4,593,495 6/1986 Kawakami et al. ..... 451/256
5,081,796 1/1992 Schultz ..... 451/41
5,174,067 12/1992 Hasegawa et al. ..... 51/133
5,329,732 7/1994 Karlsrud et al. ..... 451/289
5,333,413 8/1994 Hashimoto ..... 51/165.75

*Primary Examiner*—Robert A. Rose
*Assistant Examiner*—George Nguyen
*Attorney, Agent, or Firm*—Senniger, Powers, Leavitt & Roedel

[57] ABSTRACT

An automated wafer lapping system including a robot which loads wafers from a cassette into a wafer carrier on a lapping machine one at a time and one after another. The robot is capable of delivering lapped wafers to a thickness gauging device for measuring the wafer thickness and recalibrating the lapping machine between each run. Openings in the wafer carriers for receiving wafers are sized closely to the wafer for minimal relative motion between the wafer and carrier. A centering jig and search program for the robot facilitate fast location of the wafers in the openings. The lapping system also inspects wafers for defects and sorts them accordingly after lapping.

36 Claims, 12 Drawing Sheets

204
228
230
36
212
206
P
W
214
232
234
32
234
208
210
232
222
220
218
224
236
172
P
216
226
200
238
240
24
202

AUTOMATED WAFER LAPPING SYSTEM

BACKGROUND OF THE INVENTION

This invention relates generally to wafer lapping and more particularly to an automated wafer lapping system.

Semiconductor material is typically provided to the integrated circuit industry in the form of thin wafers having at least one highly reflective, substantially damage free surface. Initially, the wafer is part of a monocrystalline ingot grown according to the Czochralski method. The ingot is roughly cylindrical in shape, and is subsequently trimmed to have a more exact cylindrical shape. The wafers are thereafter sliced from the ingot. Several processing steps well understood by those of ordinary skill in the art are subsequently performed to produce the finished wafer. The step of lapping the wafers, to which the present invention particularly relates, occurs close in the process sequence following the slicing step. Lapping is performed on both sides of the wafers to obtain a more precise thickness, to remove the non-uniform damage left by slicing and to attain a high degree of parallelism and flatness. The thickness of the wafers following lapping is slightly greater than the final thickness, because the thickness is decreased during subsequent steps such as polishing.

Lapping machines used to perform the lapping step typically include several wafer carriers which are generally circular in shape and have spaced apart holes through the carrier. Each hole is sized to receive one wafer and has a diameter somewhat larger than that of the wafer. The thickness of the carrier is less than of the wafer. The wafer carriers are supported on an annular lower plate of the lapping machine. The peripheries of the carriers are formed with teeth which mesh with pins in both inner and outer pin rings located at the internal and external peripheries, respectively, of the annular lower plate. An upper plate of the lapping machine is carried by an arm for vertical movement and swinging into and out of registration with the lower plate. The inner pin ring is driven in operation of the lapping machine to cause the wafer carriers to orbit the center of the wafer lapping machine sandwiched between the upper and lower plates while the upper and lower plates are rotated in directions opposite to each other.

Conventionally, wafers are manually loaded by a technician into respective holes in the wafer carriers on the lower plate of the lapping machine with the upper plate moved up and swung away from the lower plate. After loading, the upper plate is swung over the lower plate and lowered to sandwich the wafers between the upper and lower plates. The lapping machine is activated to rotate the wafer carriers as previously described, thereby producing relative motion between the wafers and the upper and lower plates. The relative motion produces the mechanical lapping action of the machine, which is augmented by a slurry or other agent to facilitate material removal from the wafers. The lapped wafers are then manually unloaded by the technicians.

In conventional lapping, it is not possible to track an individual wafer through the lapping process. It is imperative that the thickness of the lapped wafers be maintained within close tolerances. Accordingly measurements of the lapped batch of wafers are made by the technicians, and the lapping machine is adjusted prior to the next lapping cycle. There is a substantial delay while the measurements are made and the lapping machine is adjusted before starting another lapping cycle. To reduce the delay, only random samples from the lapped batch of wafers are measured.

There are presently automated wafer lapping systems which reduce the number of human tasks that must be performed. U.S. Pat. No. 5,174,067 ("the '067 patent") discloses automated wafer lapping apparatus in which the wafer carriers are removed from the lapping machine. The wafers are loaded one at a time into the wafer carriers, and after the carrier is filled it is placed back on the lower plate of the lapping machine. The loading proceeds until all of the carriers have been filled and set on the lapping machine lower plate. After lapping, the wafers are unloaded by removing the carrier and wafers together from the lapping machine to an unloading station. Although automated, the '067 patent introduces the extra step of removing the entire carrier before the wafers are removed from the carrier. If the lapping machine is to be adjusted to maintain a close wafer thickness tolerance, it will still be necessary for technicians to measure at least a random sampling of wafers from each lapping cycle before onset of the next lapping cycle. There is no disclosure for tracking individual wafer identity through the lapping process.

An automated lapping system disclosed in U.S. Pat. No. 5,333,413 ("the '413 patent") eliminates the step of removing the entire wafer carrier from the lapping machine. A robot arm picks up four wafers at a time and places them in four corresponding holes in a wafer carrier on the lapping machine lower plate. A sensor on the lapping machine stops the lapping machine so that a carrier is in a predetermined angular position. Sensors mounted on the robot arm locate the center of the carrier for purposes of locating the holes in the carrier for depositing and withdrawing the wafers. However, the thickness measurement of the wafers is not automated by the apparatus of the '413 patent. The '413 patent does not disclose tracking wafer identity through the lapping process.

SUMMARY OF THE INVENTION

Among the several objects and features of the present invention may be noted the provision of an automated wafer lapping system which minimizes delay between lapping each batch of wafers; the provision of such a lapping system which automatically measures the thickness of lapped wafers and adjusts a lapping machine of the system accordingly; the provision of such a lapping system which automatically inspects the wafers for defects; the provision of such a lapping system which maintains the identity of each wafer as it passes through the system; the provision of such a lapping system which precisely determines the location of a wafer carrier on a lapping machine; the provision of such a lapping system which handles wafers of different sizes with minimal alteration; and the provision of such a lapping system which prevents damage to the wafers.

Further among the several objects and features of the present invention may be noted the provision of a method for lapping wafers which achieves the advantages stated above.

Generally, an automated wafer lapping system comprising a wafer holding station for holding a plurality of wafers to be lapped and a wafer lapping machine including upper and lower lapping plates. Multiple wafer carriers located generally on the lower lapping plate each have multiple openings therethrough for receiving wafers and holding the wafers in a position between the upper and lower lapping machine plates to constrain the wafers to move conjointly with the wafer carrier. The wafer lapping machine is constructed for relative motion between the wafer carrier and the upper and lower plates thereby to remove material from the wafers to achieve a predetermined wafer thickness. The upper lapping plate is movable between a position over the lower lapping plate and a position spaced away from the lower lapping plate to expose the wafer carriers for loading and unloading wafers. A wafer transport mechanism disposed in proximity to the wafer holding station and to the wafer lapping machine is constructed for lifting wafers in the holding station one at a time and one after another out of the holding station, transporting each wafer from the holding station to the wafer lapping machine and placing the wafer in a respective one of the openings in the wafer carriers on the lower lapping plate thereby to load the wafer carriers with wafers for lapping.

In another aspect of the invention, a wafer lapping system includes a wafer lapping machine as described, and a wafer thickness gauging device. The thickness gauging device is positioned for receiving wafers from the wafer lapping machine following lapping and gauging the thickness of lapped wafers. The thickness gauging device is electronically interconnected with a wafer lapping machine controller for signalling the wafer lapping machine controller to correct any deviations of a target thickness stored in the lapping machine controller and an actual target thickness of lapped wafers according to the measurement of the wafer thickness gauging device.

In yet another aspect of the present invention, a wafer lapping system includes the wafer lapping machine and wafer transport mechanism as previously described. A controller is provided for controlling the wafer transport mechanism. A wafer carrier orientation detector is capable of detecting the orientation of the wafer carrier at a home position on the wafer lapping machine and providing a signal to the controller indicative thereof. The controller is configured to compare the orientation of each wafer carrier in the home position when the wafer carrier is loaded with the orientation of the wafer carrier in the home position when unloading after lapping so that the identity of each wafer is maintained after lapping.

In still another aspect of the present invention, a method for lapping wafers comprising the steps of providing a wafer lapping machine and wafer thickness gauging device having an active feedback relation for maintaining wafer thickness at an actual target thickness.

In a further aspect of the present invention, a method for lapping wafers includes the wafer lapping machine, controller and wafer orientation detector as previously described for maintaining wafer identity through the lapping operation.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
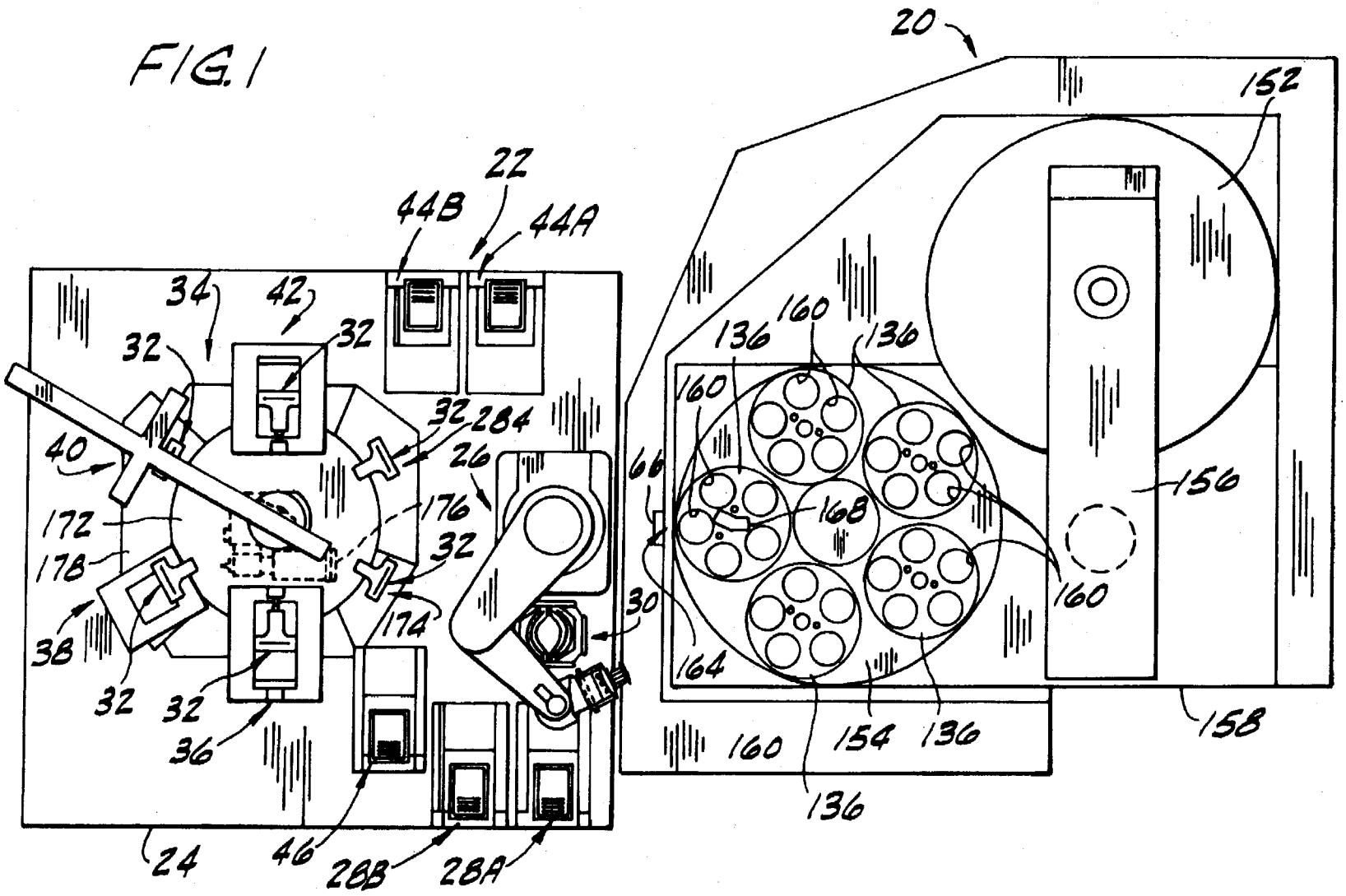
FIG. 1 is a schematic top plan view of a semiconductor wafer lapping system.

Referring now to the drawings, and in particular to FIG. 1, an automated wafer lapping system constructed according to the principles of the present invention is shown to include a wafer lapping machine and a wafer handling system (designated generally by reference numerals 20 and 22, respectively). The wafer handling system 22 components are mounted on top of an isolation table 24 next to the wafer lapping machine 20. In the preferred embodiment, the isolation table 24 and the wafer lapping machine 20 are located within a transparent enclosure (not shown) for safety purposes. As described more fully below, a robot 26 on the isolation table 24 is capable of picking wafers W from two wafer holding stations (designated generally at 28A and 28B, respectively) on the table and transferring them to a centering jig 30. The wafer W is then transferred by the robot 26 from the centering jig 30 to the lapping machine 20, and the process is repeated for a second wafer until the lapping machine is loaded. Following lapping, the wafers W are removed one at a time by the robot 26 and transferred to wafer fixtures 32 on a carousel 34 of the wafer handling system 22. The wafer W is moved by the carousel 34 through a first rinse station 36, a wafer thickness gauging station 38, a wafer inspection station 40 and a second rinse station 42. The robot 26 is capable of picking up the wafer W from the carousel 34 and placing it in either one of two offload stations (designated 44A, 44B, respectively) or in a reject station 46.

Figure 2:
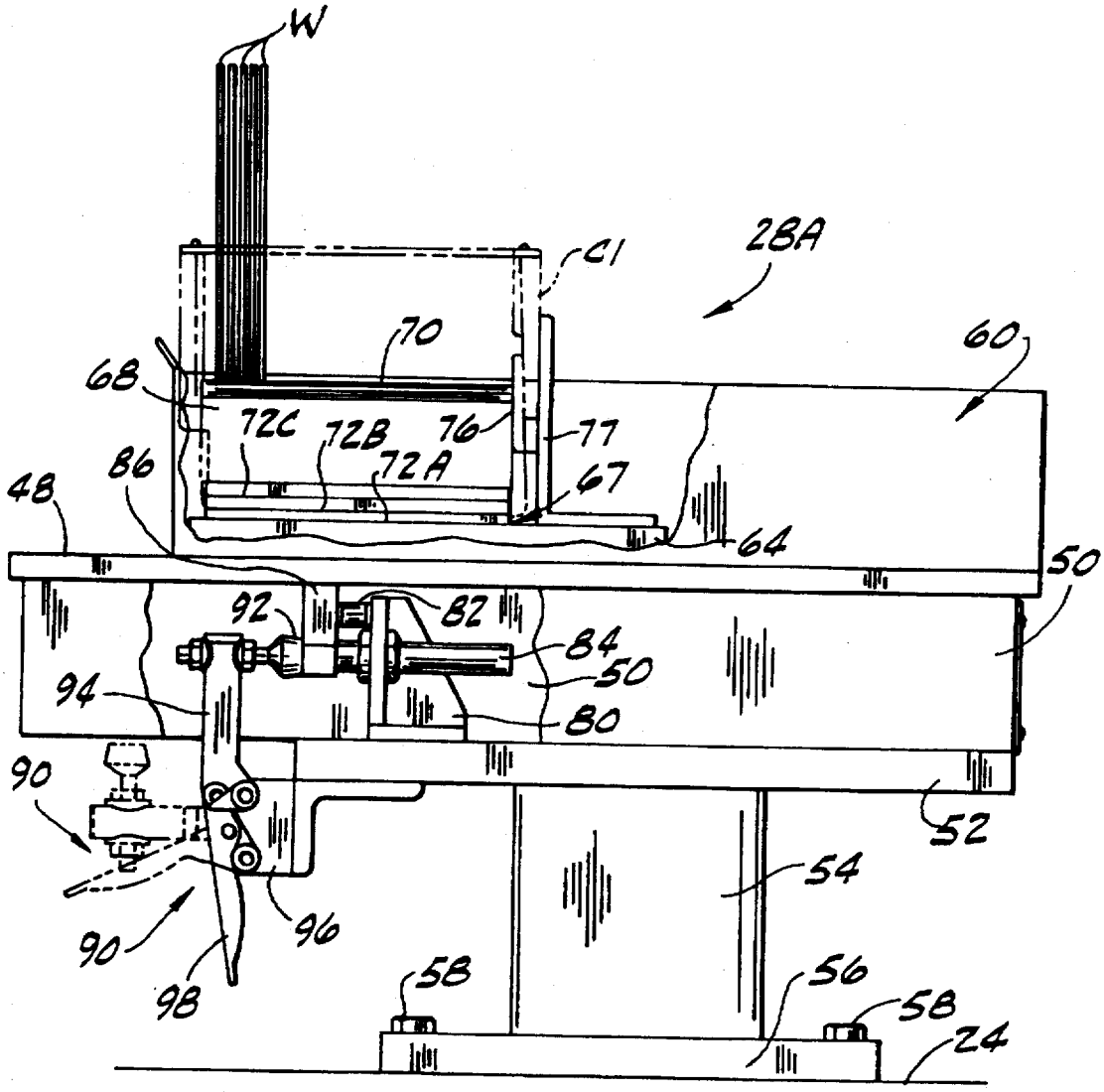
FIG. 2 is a right side elevational view of a wafer holding station of the lapping system with parts broken away to show internal construction.
Figure 3:
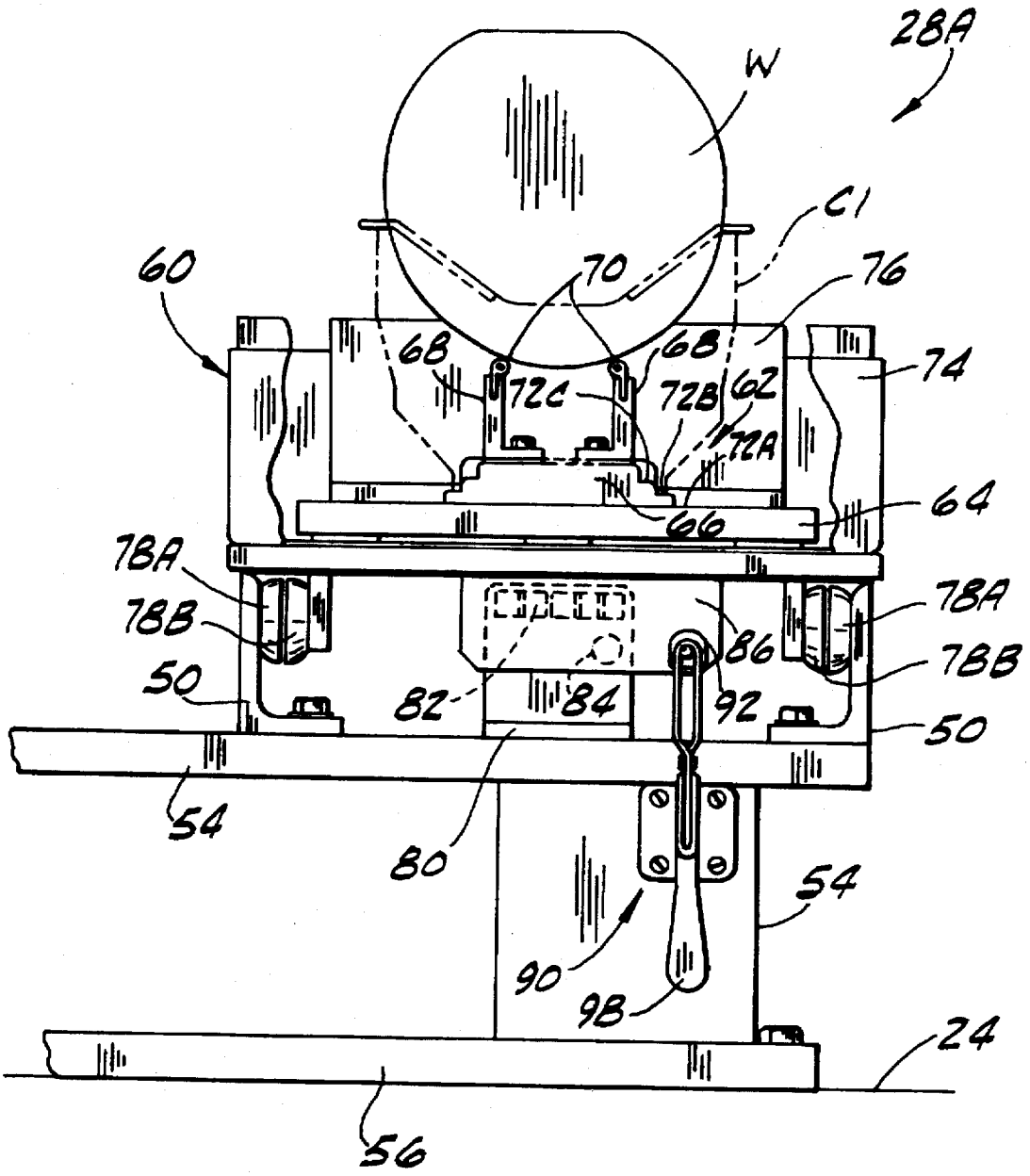
FIG. 3 is a fragmentary front elevational view of the wafer holding station with parts broken away to show internal construction.

Wafers W to be lapped are stored in cassettes C1 located in the side-by-side wafer holding stations 28A, 28B. As the wafer holding stations 28A, 28B are of identical construction, a description of one of the wafer holding stations 28A will suffice for both. Referring now to FIGS. 2 and 3 it may be seen that the wafer holding station 28A comprises a slide 48 supported by a pair of angle brackets 50 on an upper plate 52 of a pedestal 54 including also a base 56 mounted (as by bolts 58) on the top of the isolation table 24. A drip pan 60 mounted on top of the slide 48 contains a cassette platform 62 for receiving the wafer cassette C1 full of wafers W to be lapped. The wafer cassette C1 shown in phantom in FIGS. 2 and 3 is illustrated with some of the wafers W having been removed. The cassette platform 62 includes a plate 64, a stepped base 66 and a pair of spaced apart risers 68 bolted onto the top of the base and projecting up from the base. At the top of each riser 68 is a p-strip 70 extending lengthwise of the riser.

The wafer cassette C1 has an open bottom such that when the cassette is set down onto the wafer platform 62 the risers 68 pass through the open bottom, lifting the wafers W up and partially out of the cassette as illustrated. Portions of the lower edges of the wafers W engage and are supported by the p-strips 70. Steps (designated 72A–72C, respectively) of the wafer platform 62 permit the holding station 28A to receive wafer cassettes of different sizes and to positively locate the cassette in a fixed lateral position and fixed height relative to the robot 26. The cassette C1 is positively located against an outer wall 74 of the drip pan 60 by a clip 76 mounted on the wafer platform 62 by an angle bracket 77. The clip 76 opens upwardly and receives a portion of the cassette C1 between it and the angle bracket 77.

Figure 4:
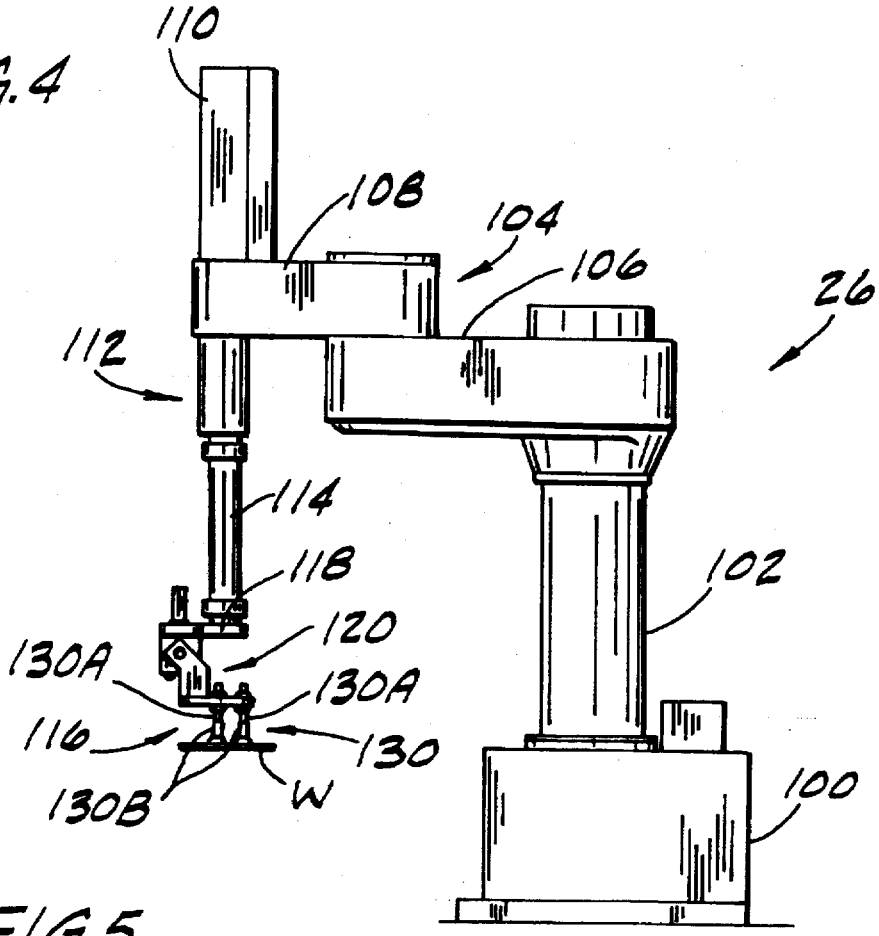
FIG. 4 is a side elevational view of an articulated robot of the lapping system.

The slide 48 is capable of sliding outwardly (i.e., to the left as shown in FIG. 4) from the isolation table 24 to a load position for loading the wafer cassette C1 onto the platform 62, and then back to its feed position. The slide 48 is mounted on the angle brackets 50 by cooperating tracks (designated 78A, 78B, respectively), permitting sliding motion between the slide 48 and the pedestal 54. A bracket 80 mounted on the upper plate 52 mounts a stop 82 and a proximity sensor 84. A plate 86 depending from the slide 48 engages the stop 82 in the feed position and is detected by the proximity sensor 84 to confirm to a system controller 88 (FIG. 16) that the slide 48 is in the feed position. A locking mechanism, indicated generally at 90, for holding the slide 48 securely in the feed position includes a hammer 92 carried by a member 94 pivotally mounted on a tab 96 on the pedestal 54. The member 96 is operated by a lever 98 also pivotally mounted on the tab 96 for movement between a locked position (shown in solid lines in FIG. 2) in which the hammer 92 engages the depending plate 86 to hold it firmly against the stop 82, and an unlocked position (shown in phantom in FIG. 2) in which the slide 48 is free to be moved out to the load position.

Figure 5:
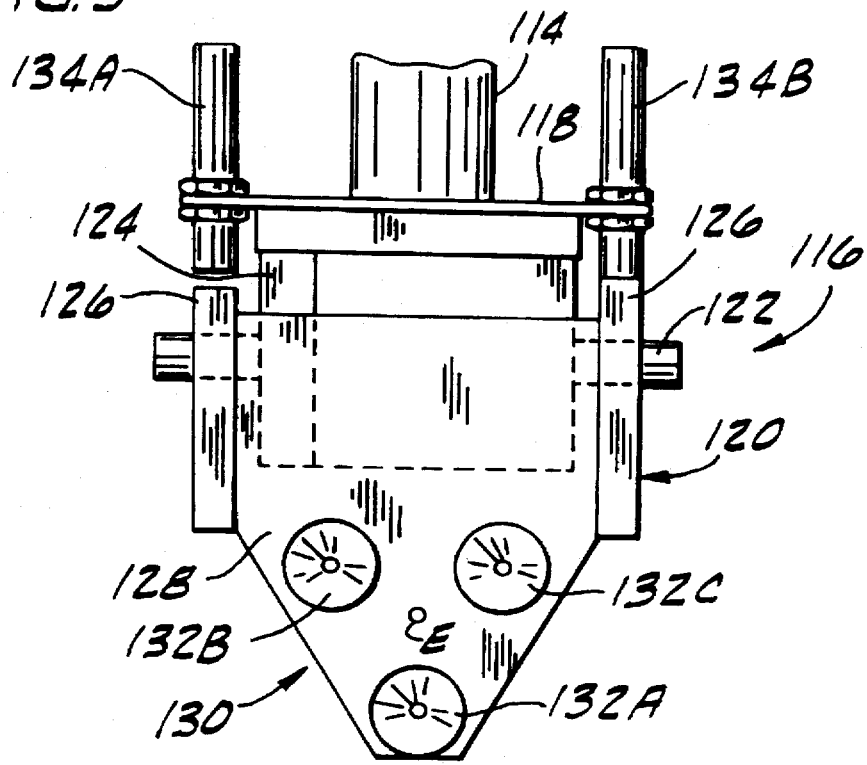
FIG. 5 is a fragmentary front elevational view of a wafer manipulator hand at the free end of the robot.

Referring to FIGS. 1, 4 and 5, handling of the wafers in the wafer handling system 22 is primarily accomplished by the articulated robot 26 having a base 100 mounted on the isolation table 24 near the wafer lapping machine 20. As shown in FIG. 4, the articulated robot 26 further comprises a support column 102 rising up from the base 100 and an articulated arm, generally indicated at 104 supported by the column and extending generally horizontally outwardly from the column. The articulated arm 104 includes a first member 106 mounted on the column 102 for pivoting about the vertical longitudinal axis of the column. A second member 108 of the arm 104 is pivotally connected to the first member 106 at an elbow for pivoting about a vertical axis relative to the first member. A barrel 110 of a combined linear/rotary actuator, generally indicated at 112, is mounted at the free end of the second member 108 and receives a rod 114 having a manipulator hand, indicated generally at 116, at its free end. The linear/rotary actuator 112 is operable to raise and lower the manipulator hand 116 (broadly, "gripper device"). As described thus far, the robot 26 is a conventional four axis robot which is available commercially. However, it is to be understood that other types of robots may be used without departing from the scope of this invention.

The manipulator hand 116 includes a platform 118 mounted at the lower end of the rod 114 and a bracket, generally indicated at 120, pivotally mounted by a pivot shaft 122 of a rotary actuator 124 which is mounted on the underside of the platform. The rotary actuator 124 is connected to a compressed air system (not shown) for selectively pivoting the pivot shaft 122 and bracket 120 about the longitudinal axis of the pivot shaft (FIG. 5). This pivoting motion provides the robot 26 with a fifth axis of operation. The bracket 120 includes a pair of mounting members 126 on either side of a central member 128. The mounting members 126 receive the pivot shaft 122. Three fingers indicated generally at 130 project outwardly from the central member 128 of the bracket 120. Fingers 130 have suction cups (designated 132A–132C) at their distal ends for applying a vacuum to grip one of the wafers W. The fingers 130 include an inner section 130A telescopically received in an outer section 130B thereby to permit relative movement between the inner and outer sections to shorten or lengthen the fingers. Springs (not shown) bias each outer section 130B axially outwardly away from the inner section 130A. Each finger 130 is connected to a vacuum system (not shown) selectively operable to apply and release the vacuum at the suction cups 132A–132C. In addition, positive air pressure is applied through the fingers 130 for making certain that the wafer is released by the robot 26.

Figure 16:
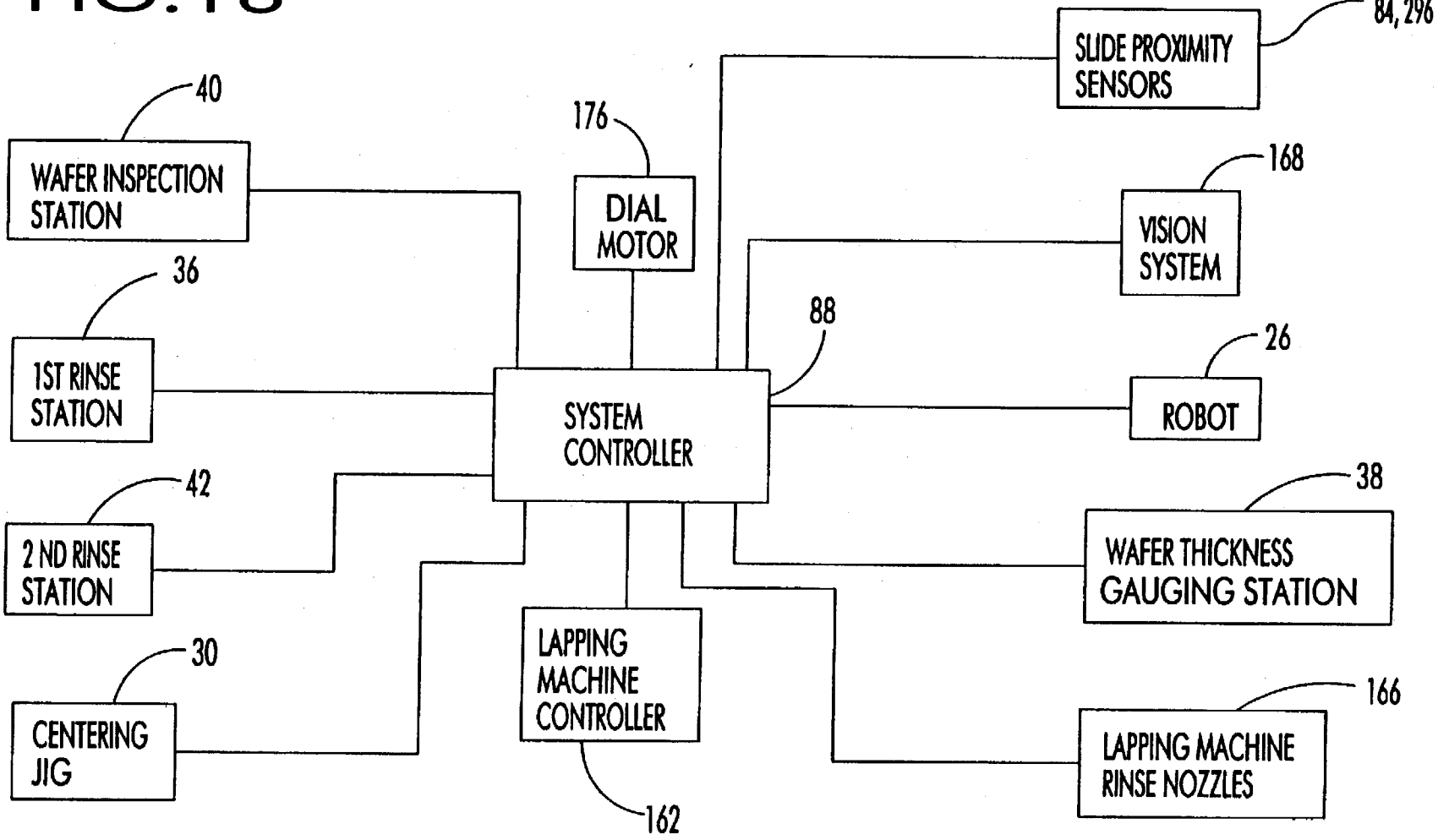
FIG. 16 is a block diagram showing a system controller of the wafer lapping system.

The rotary actuator 124 is capable of pivoting the bracket 120 between a first position (FIG. 4) in which the fingers 130 extend downwardly and hold the wafer W in a generally horizontal position, and a second position (FIGS. 1 and 5) in which the fingers extend horizontally and hold the wafer in a generally vertical position. Two proximity sensors (designated 134A, 134B, respectively) are mounted on opposite sides of the platform 118. The mounting members 126 are shaped so that the sensors 134A (the left sensor as shown in FIG. 5) detects one of the mounting members when the bracket 120 is in the first position, and the other of the sensors (the right sensor in FIG. 3) detects the other mounting member in the second position. The position of the bracket 120 detected by the proximity sensors 134A, 134B is communicated to the system controller 88 (FIG. 16).

Figure 6:
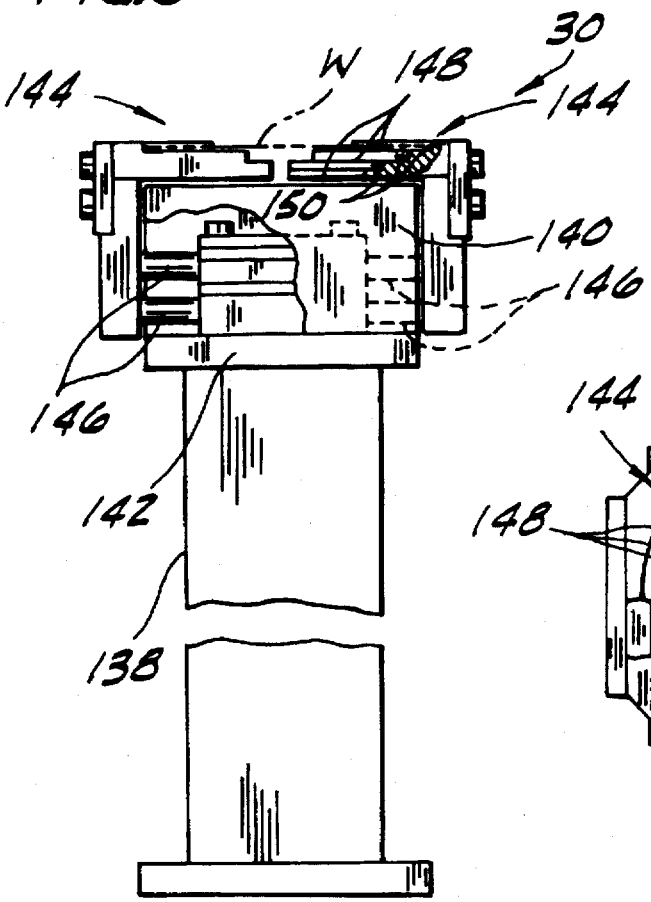
FIG. 6 is a front elevational view of a wafer centering jig of the lapping system with parts broken away to show details and a wafer shown in phantom in the jig.
Figure 7:
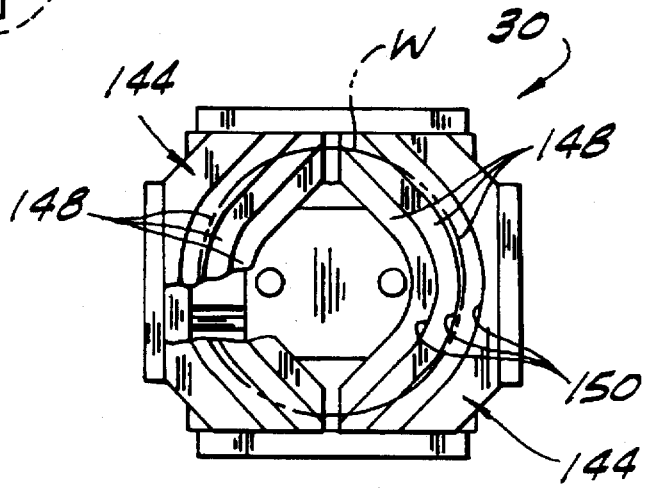
FIG. 7 is a top plan view thereof.

The robot 26 is capable of lifting wafers W one at a time and one after another out of the cassette C1 in the wafer holding station 28A. The wafers W are transported to the centering jig 30 for precisely centering the wafer on the manipulator hand 116 prior to loading into one of the openings in one of five wafer carriers 136 on the wafer lapping machine 20 (FIG. 1). Centering jig 30 is mounted on the isolation table 24 generally between the holding stations 28A, 28B and the base 100 of the robot 26. Referring to FIGS. 6 and 7, centering jig 30 includes a pedestal 138 mounting within a box 140 (partially broken away in FIG. 6) an air-operated linear actuator 142. A pair of opposing jaws (designated generally at 144) are mounted by respective pairs of rods 146 received through the box 140 and into the linear actuator 142 for movement between an open position in which the jaws are spaced relatively far apart, and a closed position in which the jaws engage each other.

Each jaw 144 is formed with three curved steps 148, and each pair of opposing steps at the same level is capable of supporting a wafer of a particular size in a substantially horizontal position. The steps 148 include shoulders 150 shaped and positioned to engage an edge of the wafer W held on the step. A wafer is shown in phantom in FIGS. 6 and 7 is supported on the uppermost steps 148. In the open position, the shoulders 150 of the steps 148 on which the wafer W is to be supported are spaced a distance substantially greater than the diameter of the wafer for receiving the (off center) wafer from the manipulator hand 116. The linear actuator 142 is then activated to move the jaws 144 to the closed position in which the shoulders 150 of opposing jaws move closer to each other to a minimum distance only slightly greater than the diameter of the wafer. To the extent that the wafer center is out of registration with the center of the centering jig 30, one or both of the shoulders 150 will engage an edge of the wafer W and move it into substantial registration with the center of the centering jig.

The robot 26 may then retrieve the wafer W with the wafer centered on the manipulator hand 116 for transport to the wafer lapping machine 20. The construction of the wafer lapping machine is conventional except where pointed out hereinafter. Accordingly, only a general description of the lapping machine 20 will be given. As shown in FIG. 1, the wafer lapping machine has an upper lapping plate 152 and an annular lower lapping plate 154. Upper lapping plate 152 is carried by a support arm 156 mounted on a base 158 of the machine 20 for swinging about a generally vertical axis between a position located away from lower plate 154 (as shown in FIG. 1) and a position directly over the lower plate.

The five wafer carriers 136 are located on the lower plate 154 of the wafer lapping machine 20. Each of the carriers 136 has five openings 160 through it which are spaced at equal intervals around the center of the carrier. The number of carriers and the number of openings in each carrier will vary depending upon the particular lapping machine and the diameter of the wafers to be lapped. Semiconductor wafers W to be lapped are received in the openings 160 of all of the carriers 136. Teeth (not shown) formed around the periphery of the each carrier 136 are enmeshed with vertical pins (not shown) located next to and spaced around the inner and outer peripheries of the annular plate.

In operation, the upper plate 152 is disposed over the lower plate 154 and lowered down so that each face of the wafers W in the wafer carriers 136 contacts a respective plate. The inner vertical pins are driven to cause the wafer carriers 136 to orbit about an axis through aligned centers of the upper and lower plates 152, 154, and to rotate about their own centers. The upper and lower plates 152, 154 are simultaneously rotated in opposite directions. The wafer lapping machine 20 has a controller 162 (FIG. 16) capable of monitoring the position of each wafer carrier 136 so that a known wafer carrier is brought back to a home position 164 (i.e., a position most closely adjacent the robot 26) at the end of lapping. Water nozzles 166 (shown schematically in FIG. 1) are mounted on the lapping machine 20 adjacent to the home position 164 for spraying the carrier 136 in the home position to clean it after lapping. At the conclusion of lapping, the upper plate 152 is raised up and swung by the support arm 156 back to the position shown in FIG. 1 so that the wafers W can be removed by the articulated robot 26.

The placement of the wafers W in corresponding openings 160 in the wafer carriers 136 requires a high level of precision by the robot 26. Removal of the wafers W requires less precision, but in order to maintain wafer identity, it is necessary for the robot 26 to know the location of each wafer in the carrier 136 at the home position 164. A vision system comprising a camera 168 (broadly, a "wafer carrier orientation detector") mounted over the center of the home position 164 for viewing the wafer carrier 136 at the home position determines the orientation of the carrier and thus the location of each wafer. The camera 168 is commercially available, and is operated by the system controller 88 also controlling the robot 26. The camera 168 views a pair of dots 170A, 170B on the wafer carrier 136 (FIGS. 8A and 8B) lying on a circle having its center at the center C of the wafer carrier and angularly spaced apart 144° (216°) from each other. Of course, the spacing of the dots 170A, 170B (broadly, "markings") may be other than described without departing from the scope of the present invention. As explained more fully below, the camera 168 is connected to the system controller 88 for comparing the original position of the wafer carrier 136 (i.e., prior to lapping, FIG. 8A) to the final position (i.e., after lapping, FIG. 8B) to determine where each individual wafer is located.

Figure 9:
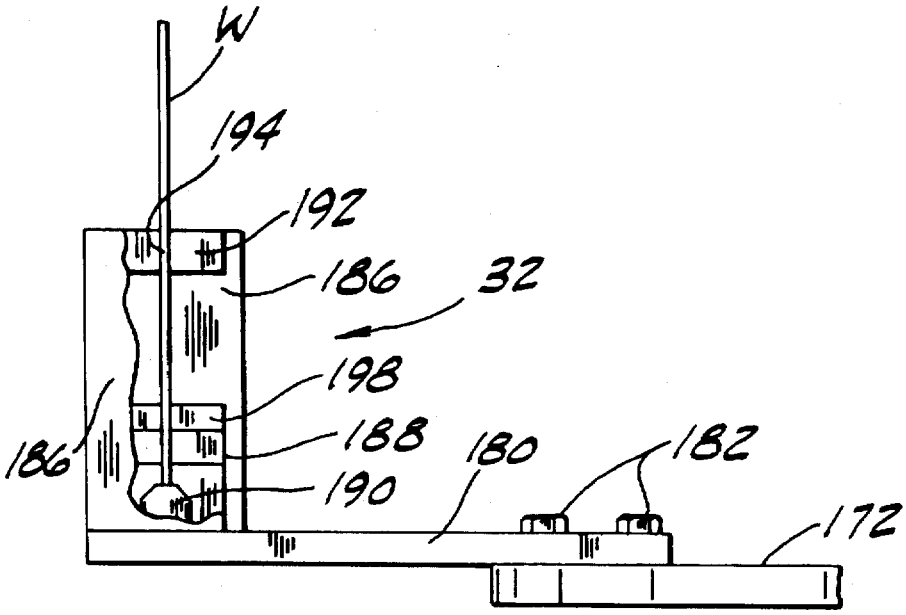
FIG. 9 is a side elevational view of a wafer fixture of a carousel of the lapping system, with parts of the wafer fixture broken away to show details of construction.
Figure 10:
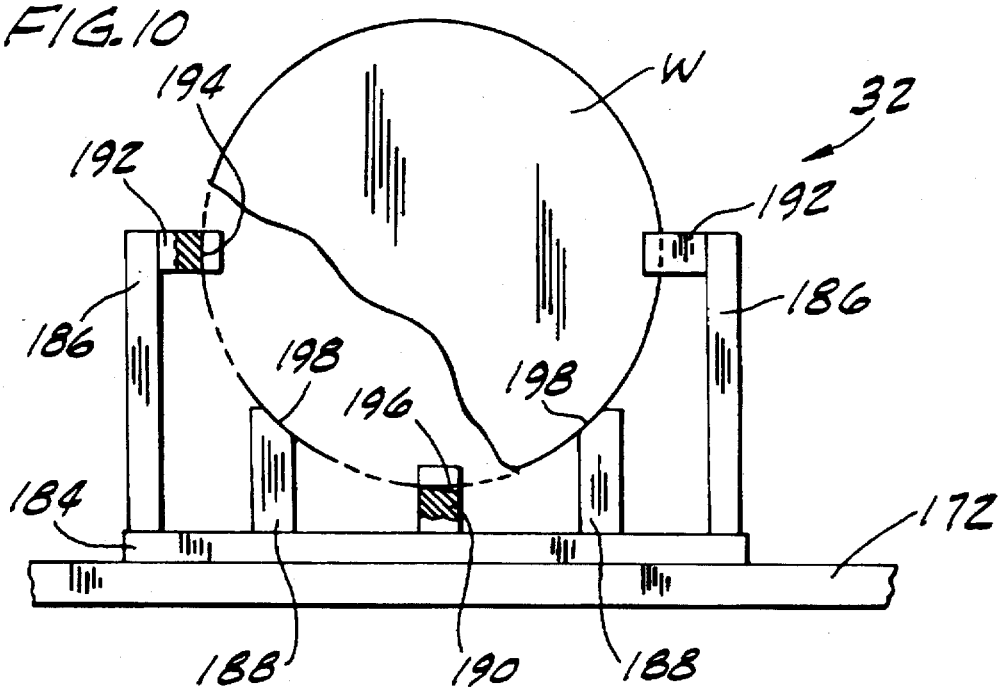
FIG. 10 is a front elevational view of the wafer fixture.

The lapped wafer W is transferred by the robot 26 from the wafer carrier 136 to the fixture 32 mounted on a dial 172 of the carousel 34 (FIG. 1). The fixture 32 is the one of six fixtures of identical construction mounted on the dial 172 disposed in a receive position 174. The dial 172 is mounted for rotation about its center and a motor 176 on the isolation table 24 under a drip pan 178 is operable to selectively drive the rotation of the dial. Referring to FIGS. 9 and 10, the fixture 32 includes a support plate 180 attached by bolts 182 at the peripheral edge margin of the dial 172 and extending radially outwardly from the periphery of the dial. A platform 184 fixed to the free end of the support plate 180 mounts left and right outer uprights 186, left and right inner uprights 188 and a central wafer support 190. As shown in FIG. 10, the outer uprights have inwardly extending projections 192 having slots 194 in their inner ends for receiving a peripheral edge margin of the wafer W. The central support 190 also has a slot 196 for receiving another portion of the wafer peripheral edge margin. Portions of central support 190, left upright 186 and the wafer W are broken away in FIG. 10 to reveal the slots 194, 196 and reception of the wafer (shown partially in phantom) in the slots. The inner uprights 188 having radiused surfaces 198 which engage and support the wafer in the fixture 32.

Figure 11:
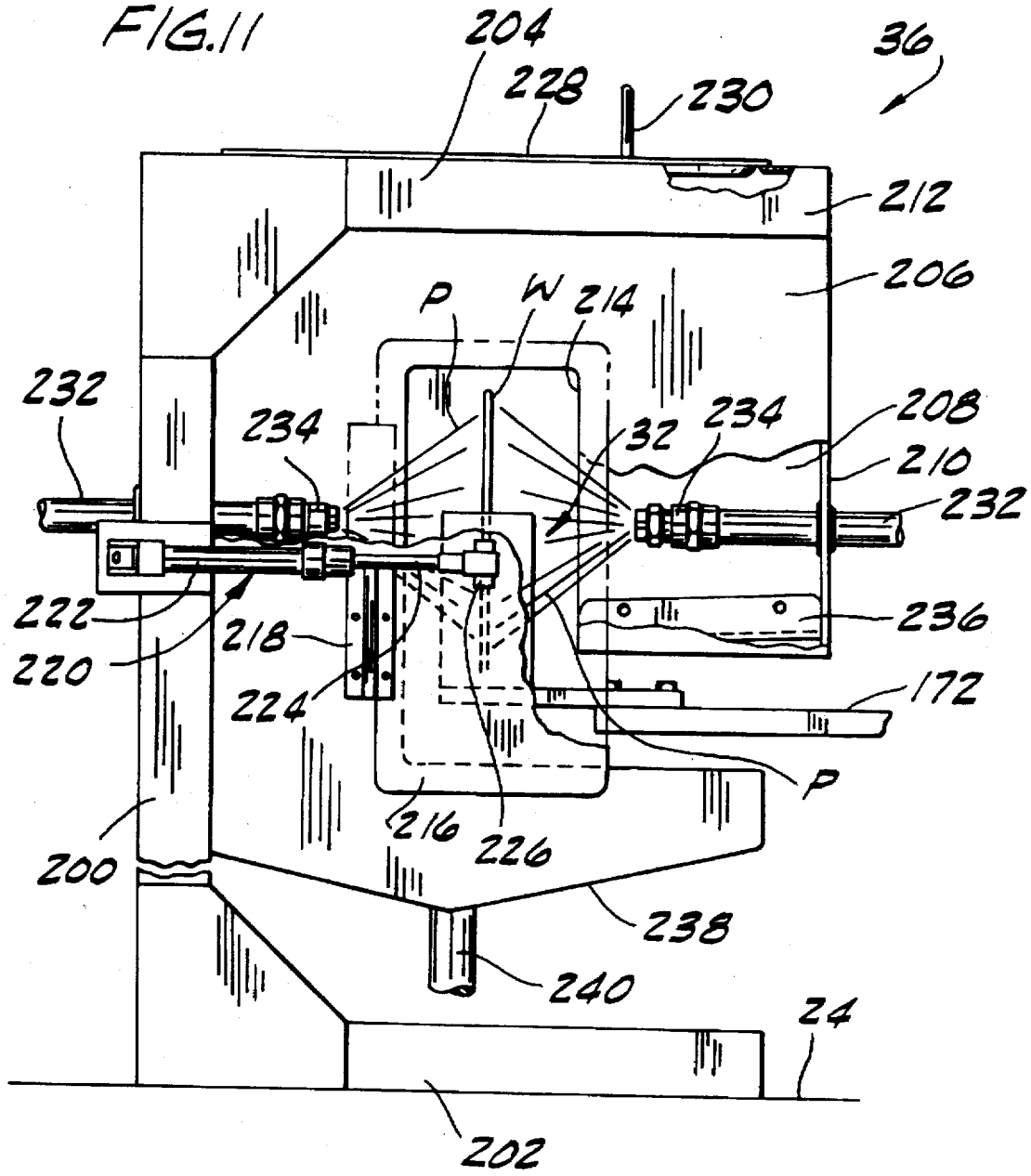
FIG. 11 is a side elevational view of a wafer rinse station of the lapping system with parts broken away to show internal construction.

The motor 176 is operated by the system controller 88 to index the dial 172 for moving the fixture 32 and wafer W held therein through six positions (including the receive position 174) in a clockwise direction as seen from the vantage of FIG. 1. The wafer W held by the fixture 32 passes first into the first rinse station 36 shown in FIG. 11 to comprise a frame having spaced apart back columns 200, feet 202 and arms 204. Only one of each of the columns 200, feet 202 and arms 204 is shown in FIG. 11, the other being located behind the one shown. The frame mounts splash shielding including a right wall 206 (partially broken away in FIG. 11 to show internal construction), a left wall 208, a front wall 210, a top wall 212 and a back wall (not shown). The right and left walls 206, 208 have substantially the same shape, including right angle slots 214 (only the slot in the right wall being shown) shaped to accommodate the fixture 32 and wafer through the right and left walls to enter and exit the first rinse station 36. The front wall 210 comes down only to the slots 214 so that the dial 172 extends through the shielding.

The slot 214 in the right wall 206 is partially covered by a door 216 mounted by a hinge 218 on the right wall. The door 216 and hinge 218 are partially broken away and shown in phantom to illustrate the internal construction of the first rinse station 36. A pneumatic cylinder, generally indicated at 220, has a barrel 222 pivotally connected at its end to the right column 200, and a rod 224 pivotally connected at its free end to an eyelet 226 on the door 216. Retraction of the rod 224 into the barrel 222 swings the door 216 on its hinge 218 from its closed position shown in FIG. 11, to an open position (not shown) in which the slot 214 is unobstructed and permits passage of the fixture 32 and wafer W into the first rinse station 36. A substantially identical door and cylinder (not shown) on the left wall 208 opens and closes the left wall slot to permit the fixture 32 and wafer W to exit the first rinse station 36. There is also a lid 228 hingedly mounted on the top wall 212 which may be manually opened by grasping its handle 230 and pulling up and to the rear for accessing the first rinse station 36 through the top wall.

Feed lines 232 extending through and supported by the front wall 210 and back wall (not shown) of the shielding, respectively, are capable of delivering a rinse liquid to nozzles 234 located respective terminal ends of the feed lines inside the first rinse station 36. As illustrated in FIG. 11, the nozzles 234 provide a spray pattern P which covers both faces of the wafer W. A gutter 236 mounted between the right and left shielding walls 206, 208 inhibits splashing of rinse solution onto the dial 172 and channels rinse solution inwardly to fall into a bottom wall 238 of the shielding. The bottom wall 238 has a generally rectangular funnel shape to direct all rinse liquid to a drain 240 in the bottom wall for passing rinse liquid to a facility drain (not shown).

Figure 13:
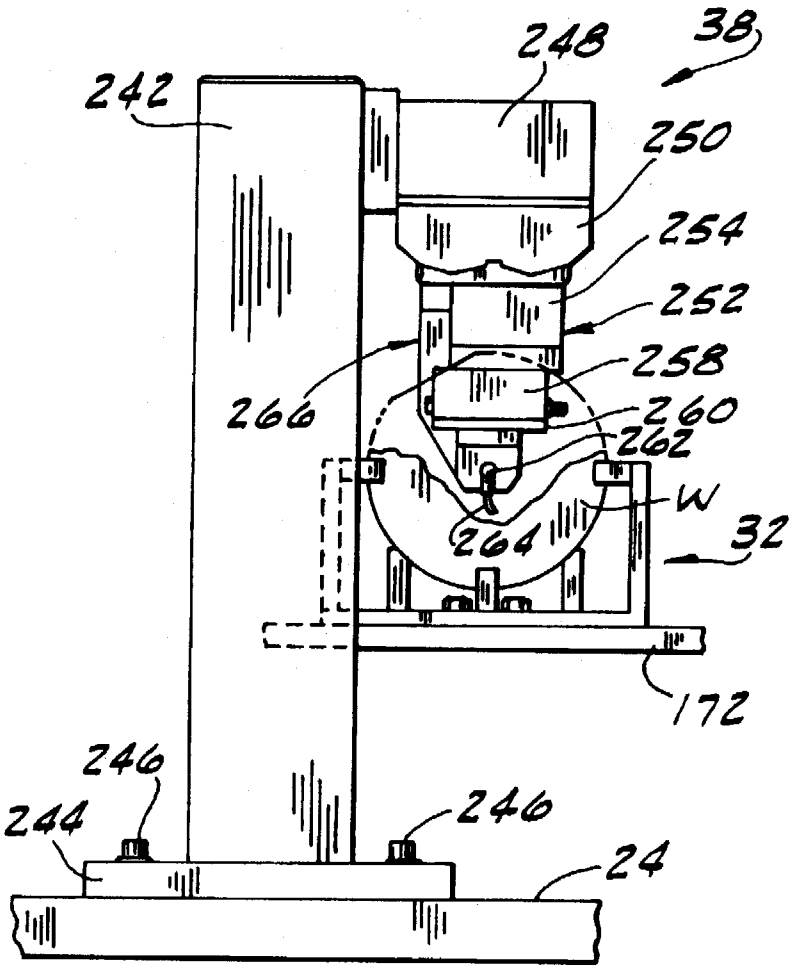
FIG. 13 is a rear elevational view of the thickness gauging station.
Figure 12:
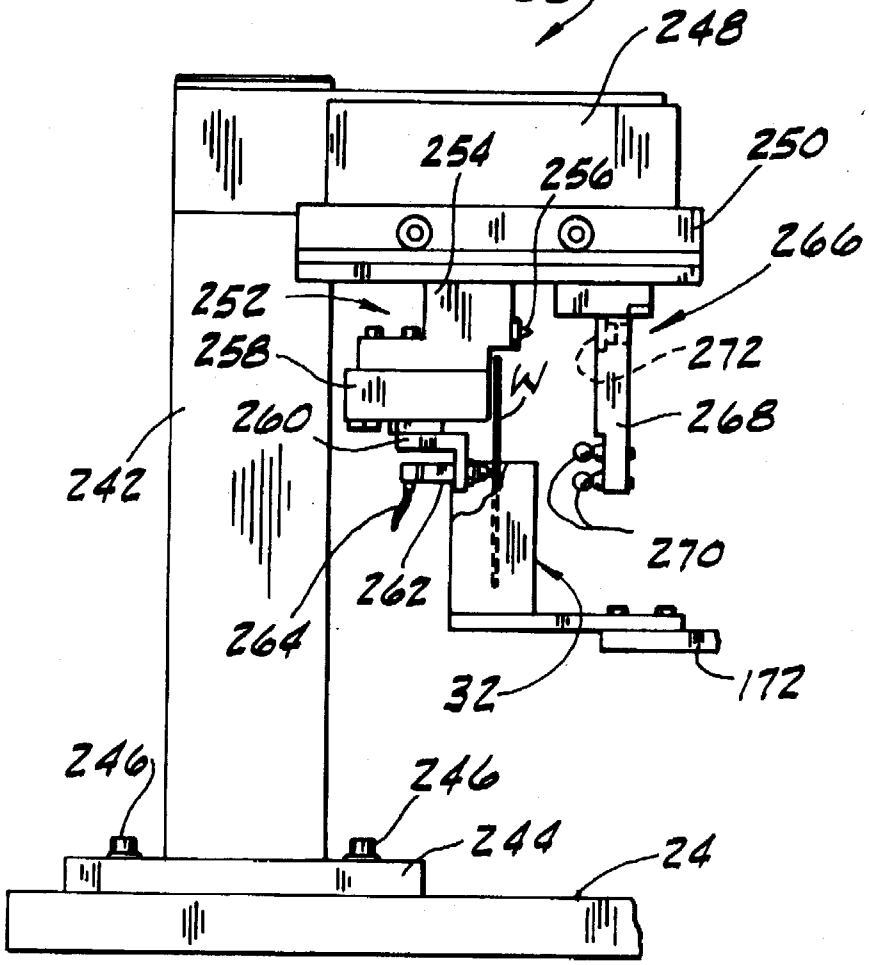
FIG. 12 is a side elevational view of a wafer thickness gauging station of the lapping system.

The fixture 32 is indexed to the thickness gauging station 38 after rinsing is completed (FIG. 1). Referring now to FIGS. 12 and 13, the thickness gauging station 38 comprises a stand 242 having a base 244 attached by bolts 246 to the isolation table 24. An arm 248 projecting inwardly toward the center of the dial 172 from the upper end of the stand 242 supports the operative components of the thickness gauging station 38 in cantilever fashion. A track 250 mounted on the underside of the arm 248 supports a probe trolley, generally indicated at 252, depending from the arm. The probe trolley 252 includes an upper member 254 mounting a conical stop 256, a lower member 258 and a probe bracket 260 supporting a line voltage distance transducer (LVDT) probe 262 connected by a cable 264 to the system controller 88. A reference trolley, generally indicated at 266, is supported from the track and includes a depending member 268 mounting a pair of reference balls 270. The depending member 268 is also formed with a conical recess 272 sized to receive the conical stop 256 on the probe trolley 252. The probe trolley 252 and reference trolley 266 are capable of movement along the track 250 for permitting the fixture 32 to enter the thickness gauging station 38 and for use in measuring the thickness of the wafer W.

Figure 14:
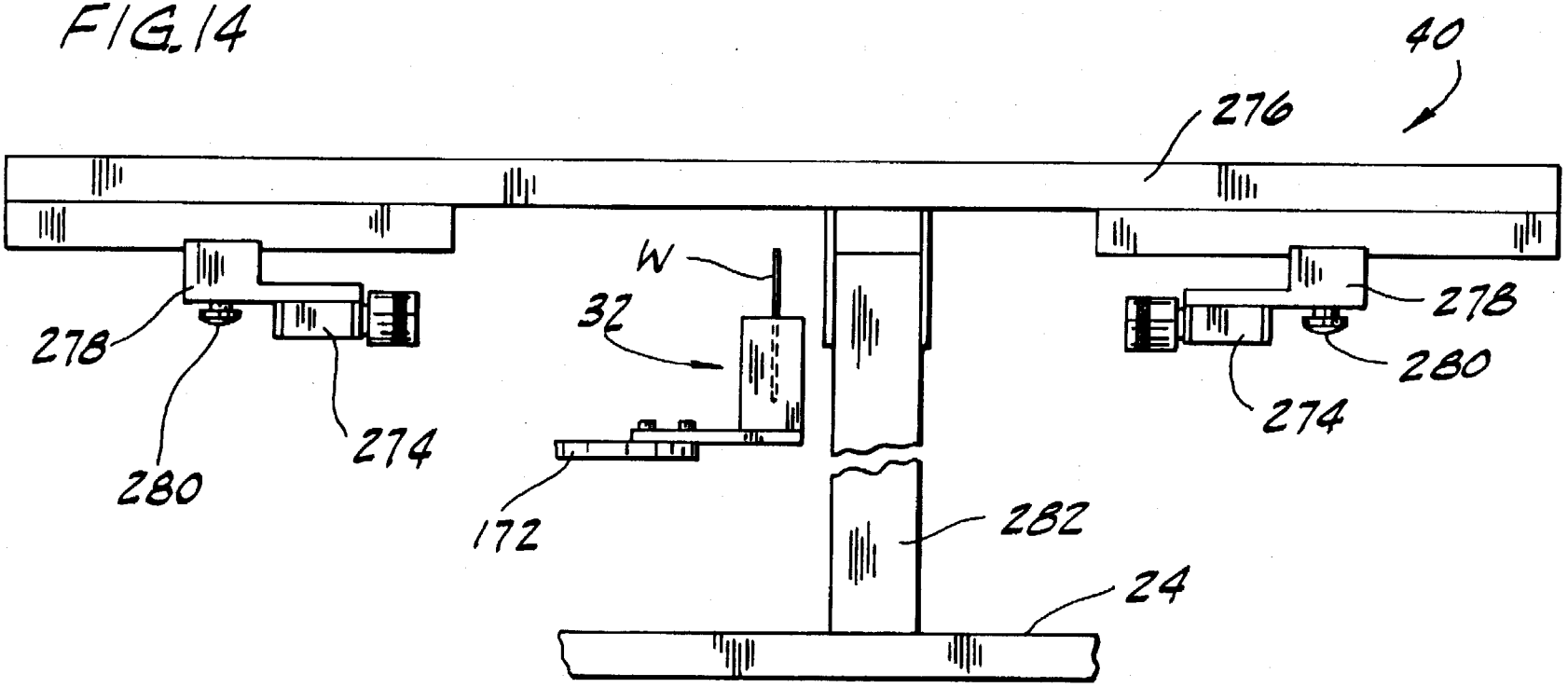
FIG. 14 is a side elevational view of a wafer inspection station of the lapping system.

As shown in FIG. 14, indexing the dial 172 to bring the fixture 32 to the wafer inspection station 40 places the wafer W between front and rear cameras 274 mounted on an elongate cross piece 276 to check for defects in the wafer. The cameras 274 are connected to the system controller 88 (FIG. 16) for affecting operation of the robot 26 as described below. The cross piece 276 extends generally radially of the dial 172 so that when the wafer W enters the station, it is positioned so that opposing faces of the wafer have an orthogonal relationship to the lines of view of the cameras 274. The cameras are mounted on the cross piece 276 by slides 278 which permit adjustment of the camera positions longitudinally of the cross piece by loosening set screws 280, moving the cameras to a new position and re-securing the set screws. The cross piece 276 is connected to the top of a post 282 projecting upward from the isolation table 24 on which it is mounted.

Referring again to FIG. 1, from the wafer inspection station 40, the fixture 32 is next indexed to the second rinse station 42 having a construction substantially identical to the first rinse station 36. The dial 172 is indexed again to bring the fixture 32 to an unload position 284 where the wafer is disposed for the robot 26 to pick it up again. The wafers W remain wetted the entire time they are on the carousel 34. The drip pan 178 located under the dial 172 captures liquid dripping off of the wafers on the carousel 34 and channels the liquid to a central opening (not shown) for passage into the facility drain.

Figure 15:
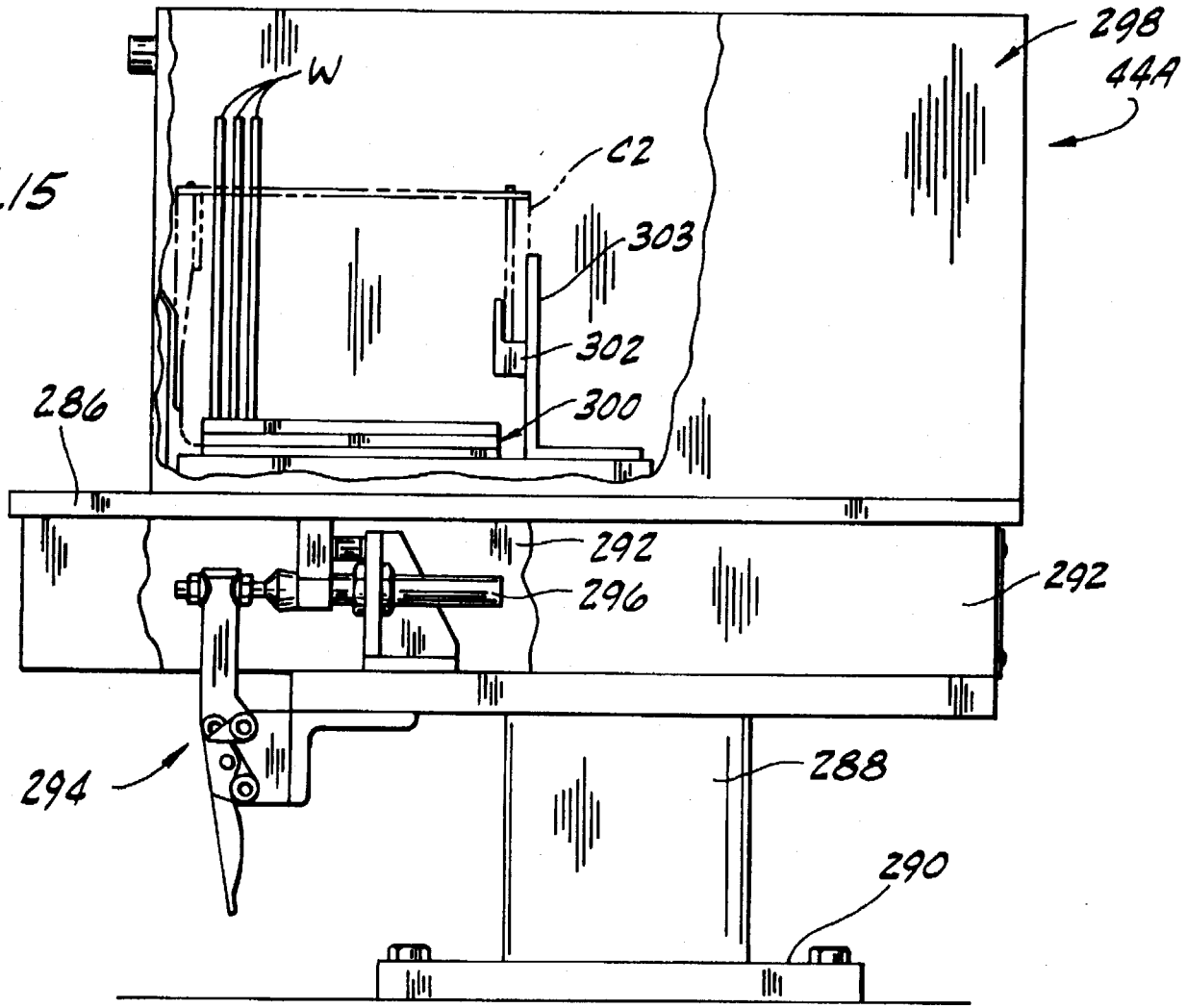
FIG. 15 is a side elevational view of a wafer offload station of the lapping system with parts broken away to show internal construction.

The robot 26 can grasp the wafer in the fixture 32 located at the unload position 284 and place it either in one of the two offload stations 44A, 44B or in the reject station 46, depending upon the information received by the system controller 88 from the wafer inspection station 40 (FIG. 1). The wafer offload stations 44A, 44B are of identical construction. Therefore a description of one of the stations 44A will suffice for both. Referring now to FIG. 15, the wafer offload station 44A may be seen to be of substantially similar construction to the wafer holding station 28A shown in FIGS. 2 and 3. More specifically, a slide 286, pedestal 288, base 290, angle brackets 292, locking mechanism 294 and proximity sensor 296 are all exactly as described for the corresponding slide 48, pedestal 54, base 56, angle brackets 50, locking mechanism 90 and proximity sensor 84 of holding station 28A. A container (indicated generally at 298) of the offload station 44A has walls which are higher than those of the drip pan 60 of the holding station 28A for holding a volume of liquid sufficient to completely immerse the wafers W held in a wafer cassette C2 (shown in phantom) in the container. However within the container 298, a cassette platform 300, a clip 302 and an angle bracket 303 are substantially identical to their counterparts (platform 62, clip 76 and angle bracket 77) of the wafer holding station 28A. There are no risers on the platform of the offload station 44A. The robot 26 places each wafer W approximately half way into the wafer cassette and then releases the wafer. The wafer W floats down through the liquid in the offload station until fully seated in the wafer cassette C2. The slide 286 permits the cassette C2 to be moved away from the isolation table 24 outside the enclosure (not shown) for removing lapped wafers from the wafer lapping system. The reject station 46 is of substantially identical construction to the offload station 44A.

Operation

Having described the structure of the wafer system of the present invention, its operation will now be described. The wafer lapping system is controlled by the system controller 88. As illustrated in FIG. 16, the system controller 88 is tied into the various system components. Although the lapping machine 20 has its own controller 162, it is a slave to the system controller 88. As an initial set up for operation, technicians place the wafer carriers 136 on the lower plate 154 of the lapping machine 20 so that each carrier can be indexed by the lapping machine to the home position 164. The slide 48 of one of the wafer holding stations (e.g., wafer holding station 28A) is unlocked and slid outwardly to its load position to load the cassette C1 of wafers W into the holding station. The wafers W are raised partially out of their cassettes by the risers 68 so that the wafers are presented for picking by the robot 26 upon being slid back to the feed position.

Figure 8A:
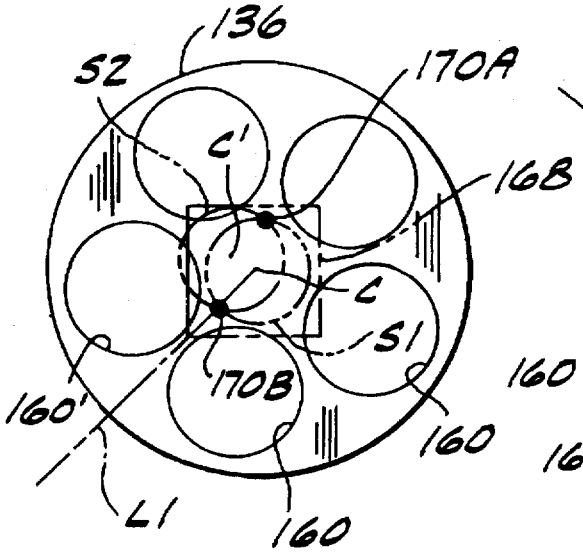
FIG. 8A is a schematic top plan view of a wafer carrier in a first position.
Figure 8B:
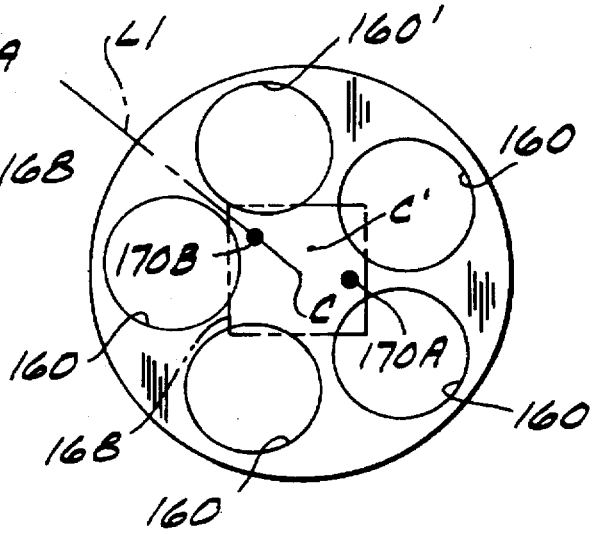
FIG. 8B is the wafer carrier of FIG. 8A in a second position rotated from the first position.

Nozzles 166 are activated to spray the wafer carrier 136 at the home position 164 to clean the carrier of debris. The vision system camera 168 takes a picture of the wafer carrier 136 in its initial home position orientation (e.g., as shown in FIG. 8A), to find the location of the two dots 170A, 170B on the carrier. The phantom representation of the camera 168 in FIGS. 8A and 8B represents the field of view of the camera in the home position 164. In the illustrated embodiment, the system controller 88 determines the location of the two possible centers C and C'. The controller 88 knows the radius of the circle on which the dots 170A, 170B lie having its center at the center C of the wafer carrier 136. The two possible centers C, C' are the two locations where the ends of lines (not shown) extending from respective dots 170A, 170B and having the same length as the radius of the circle intersect. The controller then draws two circles S1, S2 including the dots 170 and having centers at C and C', respectively. The circle S2 having center C' will extend outside the field of view of the camera. Accordingly, the system knows that the center C for the circle S1 wholly within the field of view is the actual center C of the carrier 136.

Now knowing the center C of the wafer carrier 136 and the circle S1 centered at the center of the carrier, the controller 88 measures the angles between the dots 170A, 170B beginning at each dot and moving in a clockwise direction. Starting at dot 170A and moving in a clockwise direction around center C to dot 170B, the angle measured would be 216°. Starting at dot 170B and moving in a clockwise direction around center C to dot 170A, the angle measured will be 144°. The controller 88 is pre-programmed to designate the dot 170B from which the 144° angle is measured as the locator dot. A line L1 is drawn from the center C and through locator dot 170B. The first opening clockwise of line L1 is the "first" opening 160'. The other openings are numbered according to their clockwise location from the first opening 160' around the center C of the wafer carrier 136. The controller 88 will operate to place the wafers into the wafer carrier 126 from the first opening to the fifth opening and to remove the lapped wafers in the same order.

The robot 26 is operated to move the lowermost suction cup 132A on the end of the manipulator hand finger 130 (oriented in their second position, FIG. 5) into engagement with the innermost wafer W in the wafer holding station 28A. Vacuum pressure is applied through the cup 132A to grip the wafer W. The robot linear/rotary actuator 112 is activated to raise the wafer straight up and out of the cassette C1, and the robot 26 moves the wafer clear of the holding station 28A. The rotary actuator 124 of the manipulator hand 116 is operated to pivot the hand down to its first position for holding the wafer W in a horizontal position (FIG. 4). The robot 26 moves the manipulator hand 116 over to a position in which a center point of the wafer W is roughly lined with the center of the centering jig 30. The linear/rotary actuator 112 then moves the wafer W down into centering jig 30 with the wafer engaging steps 148 on the opposing jaws 144 corresponding to the size of the wafer. The vacuum grip of the suction cup 132A is released and the wafer is supported solely by the steps 148 in the centering jig 30. The linear actuator 142 of the centering jig 30 is activated to move the jaws 144 from their open position (as shown in FIGS. 6 and 7) to the closed position (not shown) in which the jaws engage each other. To the extent that the wafer center was out of alignment with the center of the centering jig 30, the shoulders 150 on the jaws 144 engage the wafer and move it substantially into alignment.

The robot 26 is re-activated to first align a center point E of the manipulator hand 116 with the center of the centering jig 30 and then to move the cups 132A–132C of the fingers 130 down into engagement with the wafer W in the centering jig. Suction is applied to grip the wafer so that it can be lifted out of the centering jig 30 by the robot 26 with the center of the wafer now substantially aligned with the center point E of the manipulator hand 116. The robot 26 moves over to a first of the openings 160' in the wafer carrier 136 at the home position 164. The first opening 160' is determined by the orientation of the dots 170A, 170B detected by the camera 168, as described above. The linear/rotary actuator 112 moves the manipulator hand 116 down so that the wafer W passes into the opening 160', or if there is some error in alignment, at least partially engages the top of the wafer carrier 136 next to the opening.

In the preferred embodiment, the clearance between the wafer W and all carrier openings 160 is about 2 to 4 thousandths of an inch to minimize any movement of the wafers W relative to the carriers 136 during lapping. In case the wafer is not initially received in the opening 160', the robot 26 then operates to quickly find the opening. The downward movement continues so that fingers 130 bear against the wafer W and the inner sections 130A of the fingers are pushed into the outer sections 130B, compressing the springs. The compressed springs urge the outer sections 130B axially outward with a greater force so that the cups 132A–132C bear against the wafer. The vacuum pressure in the cups 132A–132C is released, and the fingers 130 are held against the wafer W only by the biasing force of the springs.

The system controller 88 operates the robot 26 so that the center point E of the manipulator hand 116 orbits about a vertical axis in progressively larger circles. The frictional engagement of the fingers 130 with the wafer W is enough to move the wafer with the fingers in the circles so long as the wafer remains outside the wafer carrier opening 160'. However when the wafer W moves into registration with the opening 160', it falls into the opening and engages the sides of the opening thereby preventing further movement with the fingers 130. In the preferred embodiment, the robot 26 moves the manipulator hand 116 in two circles, one 2 millimeters in diameter and the second 4 millimeters in diameter. However, it is to be understood that the controller 88 can be programmed to move the wafers in a greater or lesser number of circles, in circles of different diameters, and in patterns other than circles without departing from the scope of this invention.

The robot 26 moves the manipulator hand 116 back to the wafer holding station 28A and the foregoing steps are repeated until all openings 160 in the wafer carrier 136 are filled. The wafer carrier opening 160 filled after the first opening 160' is the next opening in a clockwise direction (as seen from the vantage of the camera in FIG. 8A) from the first opening. The system controller 88 then signals the lapping machine 20 to rotate the carriers 136 to bring the next carrier to the home position 164. The loading process is repeated exactly as set forth above for the second carrier 136. When all of the carriers 136 are full of wafers, the system controller 88 signals the lapping machine 20 to start the lapping cycle. The upper plate 152 swings from its position shown in FIG. 1 to a position over the lower plate 154 and is lowered down into engagement with the wafers W. The inner pin ring (not shown) and the upper and lower plates 152, 154 begin turning to remove material from both sides of the wafers until the desired thickness, as measured by the lapping machine controller 162, is achieved. As is conventional, a slurry or other suitable agent is applied to the plates 152, 154 to enhance material removal and uniformity.

The lapping machine 20 operates to bring the first wafer carrier 136 back to the home position 164. As the upper plate 152 is lifted up and moved back to the position shown in FIG. 1 to expose the lower plate 154 and the wafers on the lower plate, the nozzles 166 are reactivated to clean the wafer carrier 136 and the wafers at the home position 164. The camera 168 of the vision system again takes a picture of the wafer carrier 136 at the home position 164 (e.g., as shown in FIG. 8B) and determines its angular orientation, and hence the location of the first opening 160' in the same way as described above. The circles S1 and S2 used to determine the center C of the wafer carrier 136 have not been shown in FIG. 8B for clarity of illustration. The robot 26 is activated by the system controller 88 to move over the opening 160' containing the first wafer loaded onto the first carrier 136. The linear/rotary actuator 112 moves the manipulator hand 116 down so that the suction cups 132A–132C and the end of the fingers 130 engage the wafer. The downward movement continues until the outer sections 130B of the fingers 130 are compressed about ¼ inch against the wafer. The linear/rotary actuator 112 then moves the manipulator hand 116 up slowly for about ½ inch while the linear/rotary actuator 112 also twists the hand to gently break the surface tension of the remaining slurry which tends to adhere the wafer to the lower plate 154.

The robot 26 transfers the wafer W to the fixture 32 of the carousel 34 in the receive position 176. During transport, the rotary actuator 124 pivots the manipulator hand 116 up to its second position so that the wafer is held vertically. The linear/rotary actuator 112 moves the manipulator hand 116 down to slide the wafer through the slots 194 on the outer uprights 186 and into the fixture 32. As soon as the robot 26 releases the wafer W and moves away, the dial 172 is indexed to bring the fixture 32 into the first rinse station 36 for cleaning the wafer. The door 216 on the first rinse station 36 is initially open to permit the wafer W and fixture 32 to pass into the first rinse station. After the dial 172 is stopped with the fixture 32 in the rinse station 36, the cylinder 220 on the rinse station is operated to close the door 216. Once the door is closed, rinsing liquid is delivered to the nozzles 234 for spraying onto the opposing faces of the wafer W. At the same time, the robot 26 moves back to the wafer holding station 28A for picking up a new, unlapped wafer W from the cassette C1. The wafer is moved to the centering jig 30 and then placed by the robot 26 in the opening just vacated by the wafer being rinsed in the first rinse station 36.

The second lapped wafer in the wafer carrier 136 at the home position 164 is picked up by the robot 26 in the same manner as the first lapped wafer and transferred to the fixture 32 now occupying the receive position 174 on the carousel 34. Rinsing of the first wafer in the first rinse station 36 is completed and the cylinders 220 are activated to opening the doors 216 (only one door and cylinder being shown) of the first rinse station. The dial 172 is indexed to bring the second lapped wafer into the first rinse station 36, while the first lapped wafer passes into the wafer thickness gauging station 38. Prior to the entry of the first wafer into the station, the probe trolley 252 and reference trolley 266 may be brought together so that the conical stop 256 is received in the conical recess 272, precisely fixing the spacing between the reference balls 270 and the tip of the probe 262. The tip of the probe 262 is extended into engagement with one of the balls 70 and a reference "zero thickness" is established. The probe trolley 252 and reference trolley 266 are then moved to positions spaced far apart to permit the wafer W to pass between them into the wafer thickness gauging station 38. The probe trolley 252 and reference trolley 266 move together again so that the stop 256 on the probe trolley is received in the conical recess 272 on the reference trolley. The tip of the probe 262 is extended into engagement with the wafer W. The difference between the travel of the tip to engage the reference ball 270 and the distance travelled to engage the wafer W is the thickness of the wafer. The probe trolley 252 and reference trolley 266 then move apart to permit the first wafer to exit station 38 and the second wafer to enter. The wafer thickness gauging station 38 does not operate to establish a zero thickness again until at least after the last lapped wafer from the lapping machine 20 has passed through the station.

The robot 26 loads another unlapped wafer into the opening 160 vacated by the second wafer, and removes a third lapped wafer from the wafer carrier 136 and places it on another of the carousel fixtures 32 in the receive position 174 while the first and second lapped wafers are measured and rinsed (respectively). The next time the dial 172 is indexed, the first wafer W is brought into the wafer inspection station 40 between the cameras 274. The cameras inspect the wafer W for lapping scratches, chipped edges and to see if the wafer is broken. The system controller 88 is signalled whether the wafer is satisfactory or defective. Again, the robot 26 loads a new unlapped wafer into the wafer carrier 136 and removes a fourth lapped wafer, as previously described. The dial 172 is indexed to bring the fixture 32 carrying the first wafer into the second rinse station 42, which operates in the same manner as the first rinse station 36.

After the fifth and final lapped wafer in the first wafer carrier 136 is unloaded from the wafer carrier and placed into a fifth one of the fixtures 32 of the carousel 34, the dial 172 is indexed to bring the fixture carrying the first wafer to the unload position 284. The robot 26 removes the first wafer from the fixture 32 at unload position 284 and places it in the cassette C2 in one of the offload stations (e.g., station 44A), or if the wafer is defective, places it in the reject station 46. It will be understood that the treatment of the second and following lapped wafers on the carousel 34 will be the same as described for the first. The robot 26 then loads the fifth and final unlapped wafer into the first carrier 136 and the lapping machine 20 is indexed to bring a second of the wafer carriers into the home position 164. The unloading and reloading procedure for the second wafer carrier 136 is identical to that described for the first wafer carrier. The process is carried out until all of the wafer carriers 136 have been unloaded of lapped wafers and reloaded with unlapped wafers.

The system controller 88 stores the thickness measurements made at the wafer thickness gauging station 38. After all of the lapped wafers have been measured (25 in the illustrated embodiment), the system controller calculates the average thickness. It is to be understood that the number of lapped wafers which are measured may be less than the total number of wafers lapped without departing from the scope of the present invention. The lapping machine controller 162 is electronically advised of the calculated average to recalibrate, if necessary, a target thickness stored in the lapping machine controller according to the actual measured thicknesses of the lapped wafers, so that wafers subsequently lapped are maintained within a close tolerance of the actual target thickness. The lapping machine 20 is started after recalibration to lap the second batch of wafers. The robot 26 continues to unload wafers from fixtures 32 at the unload position 284 on the carousel 34 until all wafers from the first batch have been placed either in the wafer offload station 44A, or in the reject station 46. The filled cassette C1 may be removed by the technician from offload station 44A and replaced with an empty cassette. Similarly, the empty cassettes in the wafer holding stations 28A, 28B are removed as needed and replaced with cassettes filled with wafers needing lapping.

Figure 17:
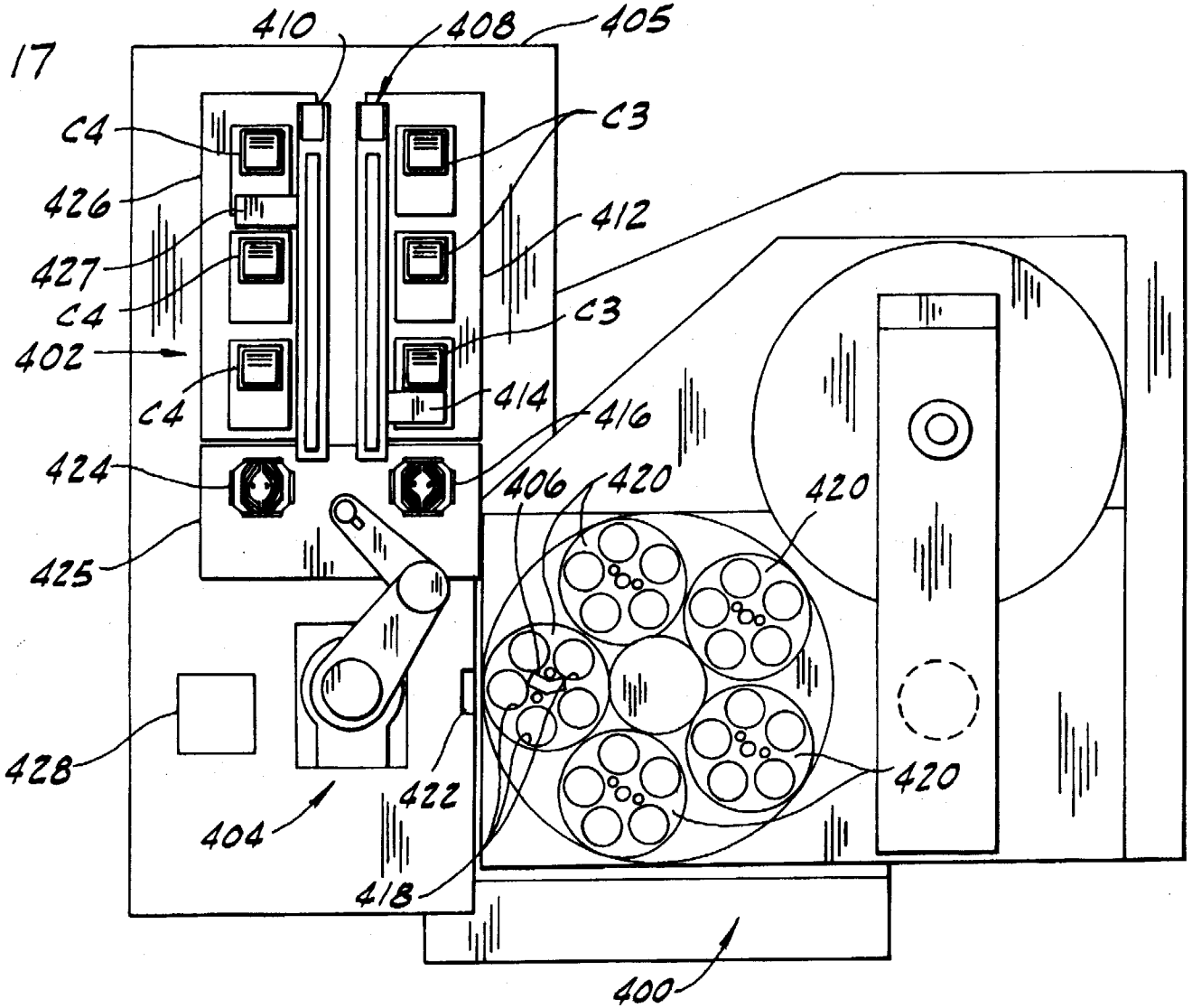
FIG. 17 is a schematic top plan view of a wafer lapping system of a second embodiment.

Referring now to FIG. 17, a wafer lapping system of a second embodiment is shown to comprise a wafer lapping machine 400 having a construction identical to the wafer lapping machine 20 of the first embodiment, and a wafer handling system 402 including a robot 404. The components of the wafer handling system 402 are mounted on an isolation table 405. As before, the wafer lapping machine 400 and wafer handling system 402 are housed within an enclosure (not shown). The construction and operation of a vision system camera 406 of the second embodiment is also identical to the camera 168 of the first. The primary distinction between the first and second embodiments is that a wafer handling system 402 of the second embodiment has no wafer inspection station or carousel, and has two linear robots (designated generally at 408 and 410, respectively) to facilitate loading and unloading of wafers from cassettes C3.

The wafer system of the second embodiment further comprises a wafer holding tank 412 sized for holding plural (three in the illustrated embodiment) cassettes C3 filled with wafers. The tank 412 is equipped with standard ultrasonic wafer cleaning equipment (not shown) for cleaning the wafers as they wait to be picked up for lapping. A first of the linear robots 408 has an arm 414 mounted for movement longitudinally along the side of the holding tank 412. A manipulator hand (not shown, but substantially the same as the manipulator hand 116 on the robot 26) is pivotally mounted on the underside of the arm 414. The arm moves linearly to place the manipulator hand adjacent to the first wafer to be picked up by the hand. The hand grips the wafer by suction, lifts it up out of the tank 412 and moves it to a first centering jig 416. The hand pivots to place the wafer in a horizontal position and the wafer is lowered into the first centering jig 416. The first centering jig 416 is of identical construction to centering jig 30 of the first embodiment.

The articulated robot 404 is substantially the same as robot 26 of the first embodiment. However at its free end, there are three fingers (not shown) which remain in a vertical orientation. The articulated robot 404 picks up the wafer out of the first centering jig 416 and places it into a first opening 418 in a wafer carrier 420 in the home position on the wafer lapping machine 400. By this time, the first linear robot 408 has already placed a second wafer in the first centering jig 416. The articulated robot 404 picks up the second and subsequent wafers from the first centering jig 416 until all wafer carriers 420 have been filled. The lapping machine 400 is then activated to lap the wafers down to a predetermined thickness in the manner previously described.

At the conclusion of lapping, the lapping machine 400 indexes the first wafer carrier 420 to the home position. The first wafer carrier and the top faces of the wafers therein are rinsed off by nozzles 422, as in the first embodiment. The vision system camera 406 determines the location of the first opening 418 in the carrier as before. The robot 404 picks the first wafer out of the wafer carrier 420 and carries it to a second centering jig 424. Nozzles (not shown) on the underside of the jig rinse the face of the wafer not previously rinsed off by nozzles 422. A drip pan 425 is located under the centering jigs 416, 424. Except for the nozzles, the second centering jig 424 is of identical construction to the first centering jig 416. The robot 420 may then transfer the wafer to a wafer thickness gauging station 428. The station uses an LVDT device to measure the thickness exactly as in wafer thickness gauging station 38 of the first embodiment. However in the second embodiment, the probe and reference balls (not shown) are oriented in vertically spaced relation. The robot places the wafer horizontally in the wafer thickness gauging station 428 for measurement.

To maximize throughput, fewer than all of the wafers are measured for thickness. In the second embodiment, only the last wafer in each carrier 420 is measured so that measuring can be done while the lapping machine 400 is indexing the next wafer carrier to the home position for unloading. Thus, wafers prior to the last wafer in the carrier 420 which are placed in the second centering jig 424 from the lapping machine are loaded into cassettes C4 in a wafer offload holding tank 426. The second linear robot 410, which is of a construction substantially identical to the first linear robot 408, has an arm 427 which picks up the wafer from the second centering jig 424 and places it in a selected one of three wafer cassettes C4 in the offload holding tank 426.

The robot 404 returns to the first centering jig 416 and picks up an unlapped wafer and places it in the wafer carrier opening 418 vacated by the first wafer. A second lapped wafer from the first wafer carrier 420 is picked up and transferred by the robot 404 to the second centering jig (which has been previously emptied of the first wafer by the second linear robot 410). The second wafer is sprayed and placed by the second linear robot 410 in the cassette C4 in a slot (not shown) next to the first wafer. The process proceeds as described until all lapped wafers have been removed and the wafer lapping machine 400 is reloaded with unlapped wafers.

The last lapped wafer unloaded from each wafer carrier 420 is taken by the robot 404 from the second centering jig 424 to the wafer thickness measuring station 428 after the last wafer is rinsed off. The robot 404 then retrieves the measured wafer and returns it to the second centering jig 424 where the second linear robot 410 can grasp the wafer and place it in one of the cassettes C4. An average of the thickness measurements from the thickness gauging station 428 is used to immediately recalibrate the lapping machine 400 before the second batch of wafers is lapped.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An automated wafer lapping system comprising:

a wafer holding station for holding a plurality of wafers to be lapped;

a wafer lapping machine including upper and lower lapping plates and multiple wafer carriers located generally on the lower lapping plate, the wafer carriers each having multiple openings therethrough for receiving wafers and holding the wafers in a position between the upper and lower lapping machine plates to constrain the wafers to move conjointly with the wafer carrier, the wafer lapping machine being constructed for relative motion between the wafer carrier and the upper and lower plates thereby to remove material from the wafers to achieve a predetermined wafer thickness, the upper lapping plate being movable between a position over the lower lapping plate and a position spaced away from the lower lapping plate to expose the wafer carriers for loading and unloading wafers;

a wafer transport mechanism disposed in proximity to the wafer holding station and to the wafer lapping machine, the wafer transport mechanism being constructed for lifting wafers in the holding station one at a time and one after another out of the holding station, transporting the wafers one at a time and one after another from the holding station to the wafer lapping machine and placing the wafers one at a time and one after another in respective ones of the openings in the wafer carriers on the lower lapping plate thereby to load the wafer carriers with wafers for lapping, and for unloading the wafers from the lapping machine one at a time and one after another after lapping.

2. A wafer lapping system as set forth in claim 1 further comprising a wafer centering jig for positioning the wafer relative to the wafer transport mechanism so that the wafer is disposed for reception in one of the openings of the wafer carriers.

3. A wafer lapping system as set forth in claim 2 wherein the wafer centering jig comprises jaws spaced substantially equidistant from each other on opposite sides of a center of the jig, the jaws being movable between an open position in which the jaws are spaced apart to receive the wafer between them, and a closed position in which the jaws are closer together thereby to move the center of the wafer to generally coincide with the center of the jig, the wafer transport mechanism being operable to place the wafer in the jig and to retrieve the wafer from the jig after centering.

4. A wafer lapping system as set forth in claim 2 wherein the wafer transport mechanism comprises a robot including a gripper device at its distal end for releasably gripping one of the wafers at a time, the gripper device being pivotable between a position in which the wafer is held generally vertically, and a position in which the wafer is held generally horizontally, the robot being pivotable to selectively position the gripper device at the wafer holding station for picking up one of the wafers, at the wafer centering jig for centering the wafer and at the wafer lapping machine for loading and unloading wafers from the wafer carriers.

5. A wafer lapping system as set forth in claim 2 wherein the wafer transport mechanism comprises a first robot including a gripper device at its distal end for releasably gripping one of the wafers at a time, and a second robot adapted to releasably grip one wafer at a time for transporting the wafer from the holding station to the centering jig, the first robot being operable to pick up the wafer from the centering jig and load it in one of the openings in one of the wafer carriers on the lapping machine.

6. A wafer lapping system as set forth in claim 5 further comprising another centering jig and an offload station, the first robot being capable of unloading a lapped wafer from the lapping machine and transporting the lapped wafer to said other centering jig, and wherein the transport mechanism further comprises a third robot for picking up the lapped wafer from said other centering jig and placing the wafer in the offload station.

7. A wafer lapping system as set forth in claim 2 further comprising a controller for controlling the transport mechanism, and a wafer carrier orientation detector for detecting the orientation of the wafer carrier at a home position on the wafer lapping machine and providing a signal to the controller indicative thereof, the controller being configured to determine the orientation of each wafer carrier in the home position when the wafer carrier is loaded and to determine the orientation of each wafer carrier in the home position when unloading after lapping so that the identity of each wafer is maintained after lapping.

8. A wafer lapping system as set forth in claim 7 wherein the wafer carrier orientation detector comprises a camera mounted for viewing the wafer carrier in the home position on the wafer lapping machine, each wafer carrier having markings thereon viewed by the camera, the detected orientation of the markings being determinative of the orientation of the wafer carrier.

9. A wafer lapping system as set forth in claim 8 wherein the camera is mounted separately from the transport mechanism above the lower lapping plate and wafer carriers, and is positioned to look down on the wafer carriers in the home position.

10. A wafer lapping system as set forth in claim 7 wherein the controller is configured to operate the transport mechanism for moving the wafer in a pattern on top of the wafer carrier for bringing the wafer into registration with one of said openings in the wafer carrier.

11. A wafer lapping machine as set forth in claim 10 wherein the controller is configured to control the transport mechanism to move the wafer about a vertical axis in circles of progressively increasing diameter for bringing the wafer into registration with a respective one of the openings in the wafer carrier.

12. A wafer lapping system as set forth in claim 10 further comprising a wafer thickness gauging device separate from the wafer lapping machine, the transport mechanism being operable to transport wafers from the lapping machine to the thickness gauging device following lapping, the thickness gauging device measuring the thickness of lapped wafers and signalling the wafer lapping machine to correct any deviations of a target thickness stored by the lapping machine and an actual target thickness of lapped wafers according to the measurements of the wafer thickness gauging device.

13. A wafer lapping system as set forth in claim 12 wherein the wafer lapping machine is capable of measuring wafer thickness for use in maintaining wafer thickness at the actual target wafer thickness, the wafer thickness gauging device being configured to average deviations in thicknesses measured from the actual target thickness and to signal the wafer lapping machine for recalibrating the target thickness stored by the wafer lapping machine.

14. A wafer lapping system as set forth in claim 12 further comprising wafer inspection apparatus disposed for receiving lapped wafers from the wafer lapping machine and inspecting the wafers for defects, a wafer offload station for receiving wafers having no defects and a reject station for receiving wafers having defects, the controller being configured to receive a signal from the wafer inspection apparatus and operating the transport mechanism to place each wafer in one of the wafer holding station and reject station according to the signal received.

15. A wafer lapping system as set forth in claim 14 wherein the transport mechanism comprises a robot positioned for loading wafers from the centering jig into the wafer carriers on the lapping machine and unloading lapped wafers from the lapping machine, the system further comprising a wafer mover including a fixture for receiving and holding the wafer, the wafer mover being operable to move the wafer through the wafer thickness gauging device and the wafer inspection apparatus and back to a location where the wafer can be picked up by the robot.

16. A wafer transport system as set forth in claim 15 wherein the wafer mover comprises a carousel including a dial mounting the wafer fixture thereon, the dial being mounted for rotation about an axis and the wafer thickness gauging device and wafer inspection apparatus being located adjacent to the perimeter of the dial.

17. A wafer lapping system as set forth in claim 1 wherein:

the holding station comprises a platform for receiving a cassette of wafers to be lapped, the platform being constructed for positively locating the cassette with respect to the wafer transport mechanism and being further sized and shaped to receive cassettes for wafers of multiple diameters;

and wherein the wafer lapping system further comprises a centering jig for positioning the wafer relative to the wafer transport mechanism so that the wafer is disposed for reception in one of the openings of the wafer carriers, the centering jig being constructed for receiving and centering wafers of multiple diameters.

18. A wafer lapping system as set forth in claim 17 wherein:

the platform of the holding station has steps formed therein along the length of the platform longitudinal edges, at least one pair of steps on opposite longitudinal edges lying substantially in the same horizontal plane for supporting a cassette of wafers of a first diameter in a raised position;

the centering jig comprises a pair of opposing jaws, the jaws being movable between an open position in which the jaws are spaced apart to receive the wafer between them, and a closed position in which the jaws are closer together thereby to move the center of the wafer to generally coincide with the center of the jig, each jaw having at least two curved steps formed therein, pairs of steps on opposite jaws lying substantially in the same horizontal plane for receiving a wafer of a corresponding diameter.

19. A wafer lapping system comprising:

a wafer lapping machine including upper and lower lapping plates and multiple wafer carriers located generally on the lower lapping plate, the wafer carriers each having multiple openings therethrough for receiving wafers and holding the wafers in a position between the upper and lower lapping machine plates to constrain the wafers to move conjointly with the wafer carrier, the wafer lapping machine being constructed for relative motion between the wafer carrier and the upper and lower plates thereby to remove material from the wafers to achieve a target wafer thickness, the lapping machine including a controller for stopping the lapping action of the lapping machine when the target thickness of the wafers has been reached, the upper lapping plate being movable between a position over the lower lapping plate and a position spaced away from the lower lapping plate to expose the wafer carriers for loading and unloading wafers;

a wafer thickness gauging device separate from the wafer lapping machine, the thickness gauging device being positioned for receiving wafers from the wafer lapping machine following lapping and gauging the thickness of lapped wafers, the thickness gauging device being electronically interconnected with the wafer lapping machine controller for signalling the wafer lapping machine controller to correct any deviations of the target thickness stored in the lapping machine controller and an actual target thickness of lapped wafers according to the measurement of the wafer thickness gauging device.

20. A wafer lapping system as set forth in claim 19 wherein the wafer thickness gauging device is configured to average deviations from the actual target thickness and to signal the wafer lapping machine controller for recalibrating the target thickness gauging of the wafer lapping machine controller.

21. A wafer lapping system as set forth in claim 19 further comprising:

a wafer holding station for holding a plurality of wafers to be lapped;

a wafer transport mechanism for loading the wafers at the wafer holding station in the wafer carriers for lapping and for removing the wafers from the wafer carriers following lapping and transporting the wafers to the wafer thickness gauging device, the wafer transport mechanism having a controller for controlling operation of the wafer transport mechanism, the controller being further configured to control the transport mechanism to unload the wafers from the lapping machine after lapping.

22. A wafer lapping system as set forth in claim 21 further comprising wafer inspection apparatus disposed for receiving lapped wafers from the wafer lapping machine and inspecting the wafers for defects, a wafer offload station for receiving wafers having no defects and a reject station for receiving wafers having defects, the wafer transport mechanism controller being configured to receive a signal from the wafer inspection apparatus and operating the wafer transport mechanism to place each wafer in one of the wafer holding station and reject station according to the signal received.

23. A wafer lapping system as set forth in claim 21 wherein:

the holding station comprises a platform for receiving a cassette of wafers to be lapped, the platform being constructed for positively locating the cassette with respect to the wafer transport mechanism and being further sized and shaped to receive cassettes for wafers of multiple diameters;

and wherein the wafer lapping system further comprises a centering jig for positioning the wafer relative to the wafer transport mechanism so that the wafer is disposer for reception in one of the openings of the wafer carriers, the centering jig being constructed for receiving and centering wafers of multiple diameters.

24. A wafer lapping system as set forth in claim 21 further comprising a wafer carrier orientation detector for detecting the orientation of the wafer carrier at a home position on the wafer lapping machine and providing a signal to the transport mechanism controller indicative thereof, the controller being configured to determine the orientation of each wafer carrier in the home position when the wafer carrier is loaded and to determine the orientation of each wafer carrier in the home position when unloading after lapping so that the identity of each wafer is maintained after lapping, the wafer carrier orientation detector comprising a camera mounted for viewing the wafer carrier in the home position on the wafer lapping machine, each wafer carrier having markings thereon viewed by the camera, the detected orientation of the markings being determinative of the orientation of the wafer carrier.

25. A wafer lapping system as set forth in claim 24 wherein the controller is configured to operate the transport mechanism for moving the wafer in a pattern on top of the wafer carrier for bringing the wafer into registration with one of said openings in the wafer carrier.

26. A wafer lapping system, comprising:

a wafer holding station for holding a plurality of wafers to be lapped;

a wafer lapping machine including upper and lower lapping plates and multiple wafer carriers located generally on the lower lapping plate, the wafer carriers each having multiple openings therethrough for receiving wafers and holding the wafers in a position between the upper and lower lapping machine plates to constrain the wafers to move conjointly with the wafer carrier, the wafer lapping machine being constructed for relative motion between the wafer carrier and the upper and lower plates thereby to remove material from the wafers to achieve a target wafer thickness, the upper lapping plate being movable between a position over the lower lapping plate and a position spaced away from the lower lapping plate to expose the wafer carriers for loading and unloading wafers;

a wafer transport mechanism disposed in proximity to the wafer holding station and to the wafer lapping machine, the wafer transport mechanism being constructed for lifting wafers out of the holding station, transporting the wafers from the holding station to the wafer lapping machine and placing the wafers in respective ones of the openings in the wafer carriers on the lower lapping plate thereby to load the wafer carriers with wafers for lapping, and further constructed for unloading the wafers from the lapping machine after lapping;

a controller for controlling the wafer transport mechanism;

a wafer carrier orientation detector for detecting the orientation of the wafer carrier about a vertical axis passing through the center of the wafer carrier at a home position on the wafer lapping machine and providing a signal to the controller indicative thereof, the controller being configured to identify the location of each individual opening in the wafer carrier when the wafer carrier is loaded and to identify the location of each individual opening in the wafer carrier when unloading after lapping so that the identity of each wafer is maintained after lapping.

27. A wafer lapping system as set forth in claim 26 wherein the wafer carrier orientation detector comprises a camera mounted for viewing the wafer carrier in the home position on the wafer lapping machine, each wafer carrier having markings thereon viewed by the camera, the detected orientation of the markings being determinative of the orientation of the wafer carrier.

28. A wafer lapping system as set forth in claim 27 wherein the camera is mounted separately from the transport mechanism above the lower lapping plate and wafer carriers, and is positioned to look down on the wafer carriers in the home position.

29. A wafer lapping system as set forth in claim 27 wherein the controller is configured to operate the transport mechanism for moving the wafer in a pattern on top of the wafer carrier for bringing the wafer into registration with one of said openings in the wafer carrier.

30. A wafer lapping machine as set forth in claim 29 wherein the controller is configured to control the transport mechanism to move the wafer about a vertical axis in circles of progressively increasing diameter for bringing the wafer into registration with a respective one of the openings in the wafer carrier.

31. A wafer lapping system as set forth in claim 29 further comprising a wafer centering jig for positioning the wafer relative to the wafer transport mechanism so that the wafer is disposed for reception in one of the openings of the wafer carriers.

32. A wafer lapping system as set forth in claim 31 wherein the wafer centering jig comprises jaws spaced substantially equidistant from each other on opposite sides of a center of the jig, the jaws being movable between an open position in which the jaws are spaced apart to receive the wafer between them, and a closed position in which the jaws are closer together thereby to move the center of the wafer to generally coincide with the center of the jig, the wafer transport mechanism being operable to place the wafer in the jig and to retrieve the wafer from the jig after centering.

33. A wafer lapping system as set forth in claim 26 further comprising a wafer thickness gauging device separate from the wafer lapping machine, the transport mechanism being operable to transport wafers from the lapping machine to the thickness gauging device following lapping, the thickness gauging device measuring the thickness of lapped wafers and signalling the wafer lapping machine to correct any deviations of the target thickness stored in the lapping machine from an actual target thickness of lapped wafers according to the measurement of the wafer thickness gauging device.

34. A wafer lapping system as set forth in claim 26 further comprising wafer inspection apparatus disposed for receiving lapped wafers from the wafer lapping machine and inspecting the wafers for defects, a wafer offload station for receiving wafers having no defects and a reject station for wafers having defects, the controller being configured to receive a signal from the wafer inspection apparatus and operating the transport mechanism to place each wafer in one of the wafer holding station and reject station according to the signal received.

35. A method for automatic feedback control in wafer lapping, the method comprising the steps of:

providing a wafer lapping machine including upper and lower lapping plates and multiple wafer carriers located generally on the lower lapping plate, the wafer carriers each having multiple openings therethrough for receiving wafers and holding the wafers in a position between the upper and lower lapping machine plates to constrain the wafers to move conjointly with the wafer carrier, the wafer lapping machine being constructed for relative motion between the wafer carrier and the upper and lower plates thereby to remove material from the wafers to achieve a target wafer thickness, the lapping machine including a controller for stopping the lapping action of the lapping machine when the target thickness of the wafers has been reached, the upper lapping plate being movable between a position over the lower lapping plate and a position spaced away from the lower lapping plate to expose the wafer carriers for loading and unloading wafers;

providing a wafer thickness gauging device separate from the wafer lapping machine, the thickness gauging device being positioned for receiving wafers from the wafer lapping machine following lapping and gauging the thickness of lapped wafers;

loading a first batch of wafers in the wafer carriers on the lapping machine;

operating the lapping machine to lap the wafers to the target thickness as measured by the lapping machine and determined by the lapping machine controller;

removing lapped wafers from the lapping machine;

measuring the actual thickness of a predetermined number of the lapped wafers with the thickness gauging device;

generating a signal representative of the average measured thickness of the predetermined number of lapped wafers measured with the thickness gauging device;

generating a feedback signal representative of the deviation of the average measured thickness from an actual target thickness of the wafers;

transmitting the feedback signal to the wafer lapping machine controller to recalibrate the lapping machine controller so that the target thickness corresponds with the actual target thickness.

36. A method for automatically lapping wafers comprising the steps of:

(a) providing a wafer holding station for holding a plurality of wafers to be lapped;

(b) providing a wafer lapping machine including upper and lower lapping plates and multiple wafer carriers located generally on the lower lapping plate, the wafer carriers each having multiple openings therethrough for receiving wafers and holding the wafers in a position between the upper and lower lapping machine plates to constrain the wafers to move conjointly with the wafer carrier, the wafer lapping machine being constructed for relative motion between the wafer carrier and the upper and lower plates thereby to remove material from the wafers to achieve a target wafer thickness, the lapping machine including a controller for stopping the lapping action of the lapping machine, the upper lapping plate being movable between a position over the lower lapping plate and a position spaced away from the lower lapping plate to expose the wafer carriers for loading and unloading wafers;

(c) providing a wafer transport mechanism disposed in proximity to the wafer holding station and to the wafer lapping machine, the wafer transport mechanism having a controller to control the transport mechanism for lifting wafers in the holding station and transporting the wafers from the holding station to the wafer lapping machine thereby to load the lapping machine with wafers for lapping, and for unloading the wafers from the lapping machine after lapping;

(d) providing a vision system including a camera disposed over a home position on the lower plate of the wafer lapping machine;

(e) taking a picture with the camera of a first of the wafer carriers in the home position on the lower lapping plate to locate markings on the first wafer carrier;

(f) determining the location of a first of the openings in the first wafer carrier using the markings as a reference;

(g) loading wafers from the wafer holding station into the first wafer carrier with the wafer transport mechanism one at a time and one after another beginning with the first opening in the first wafer carrier and proceeding to the next adjacent one of the openings until all openings therein are filled;

(h) indexing the wafer lapping machine to bring a second of the wafer carriers into the home position;

(i) repeating steps (e)–(h) until all wafer carriers have been loaded with wafers;

(j) operating the wafer lapping machine to lap the wafers;

(k) bringing the first wafer carrier back to said home position;

(l) taking a picture with the camera of the first wafer carrier in the home position to locate markings on the first wafer carrier;

(m) determining the location of the first opening in the first wafer carrier using the markings as a reference;

(n) unloading wafers from the first wafer carrier with the wafer transport mechanism one at a time and one after another beginning with the first opening in the first wafer carrier and proceeding to the next adjacent one of the openings until all openings therein are emptied of wafers;

(o) indexing the wafer lapping machine to bring the second wafer carrier into the home position;

(p) repeating steps (l)–(o) until all wafer carriers have been emptied of wafers.

* * * * *